US007920099B2

(12) United States Patent
Chiu et al.

(10) Patent No.: US 7,920,099 B2
(45) Date of Patent: Apr. 5, 2011

(54) MULTIPLE-INPUT-MULTIPLE-OUTPUT WIRELESS COMMUNICATIONS CUBE ANTENNAS

(75) Inventors: Chi Yuk Chiu, Hong Kong (CN); Jie Bang Yan, Hong Kong (CN); Ross David Murch, Hong Kong (CN)

(73) Assignee: Shenloon Kip Assets, LLC, Wilmington, DE (US)

( * ) Notice: Subject to any disclaimer, the term of this patent is extended or adjusted under 35 U.S.C. 154(b) by 491 days.

(21) Appl. No.: 12/129,025

(22) Filed: May 29, 2008

(65) Prior Publication Data

US 2008/0303733 A1 Dec. 11, 2008

Related U.S. Application Data

(60) Provisional application No. 60/942,591, filed on Jun. 7, 2007.

(51) Int. Cl.
*H01Q 13/10* (2006.01)

(52) U.S. Cl. ..... 343/770; 343/767; 343/797

(58) Field of Classification Search ..... None
See application file for complete search history.

(56) References Cited

U.S. PATENT DOCUMENTS

| | | | | |
|---|---|---|---|---|
| 6,891,511 | B1 * | 5/2005 | Angelucci | 343/767 |
| 7,109,943 | B2 * | 9/2006 | McCarville et al. | 343/797 |
| 7,358,912 | B1 * | 4/2008 | Kish et al. | 343/725 |
| 7,675,474 | B2 * | 3/2010 | Shtrom et al. | 343/853 |
| 7,710,343 | B2 * | 5/2010 | Chiu et al. | 343/797 |
| 2002/0175862 | A1 * | 11/2002 | Hunter et al. | 343/700 MS |
| 2006/0055613 | A1 * | 3/2006 | Angelucci | 343/770 |
| 2006/0082515 | A1 * | 4/2006 | Petropoulos et al. | 343/795 |

* cited by examiner

*Primary Examiner* — Trinh V Dinh
(74) *Attorney, Agent, or Firm* — Turocy & Watson, LLP

(57) ABSTRACT

Compact 24-port and 36-port multiple-input-multiple-output (MIMO) antenna designs and methods of construction based on a cube-like structure are provided. The antennas can be implemented with slot antennas distributed on the edges and faces of cubes. According to various embodiments of the disclosed subject matter, both spatial and polarization diversity can be achieved and average mutual couplings among the ports better than −20 dB can be achieved providing good channel capacity in MIMO applications. The disclosed details enable various refinements and modifications according to antenna and system design considerations.

20 Claims, 21 Drawing Sheets

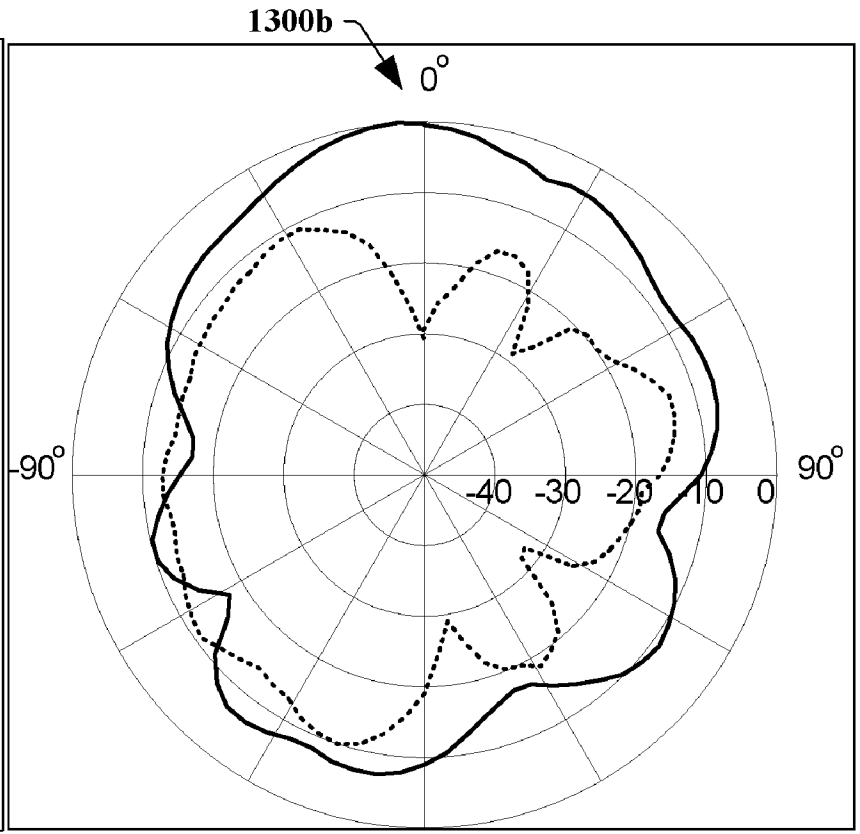
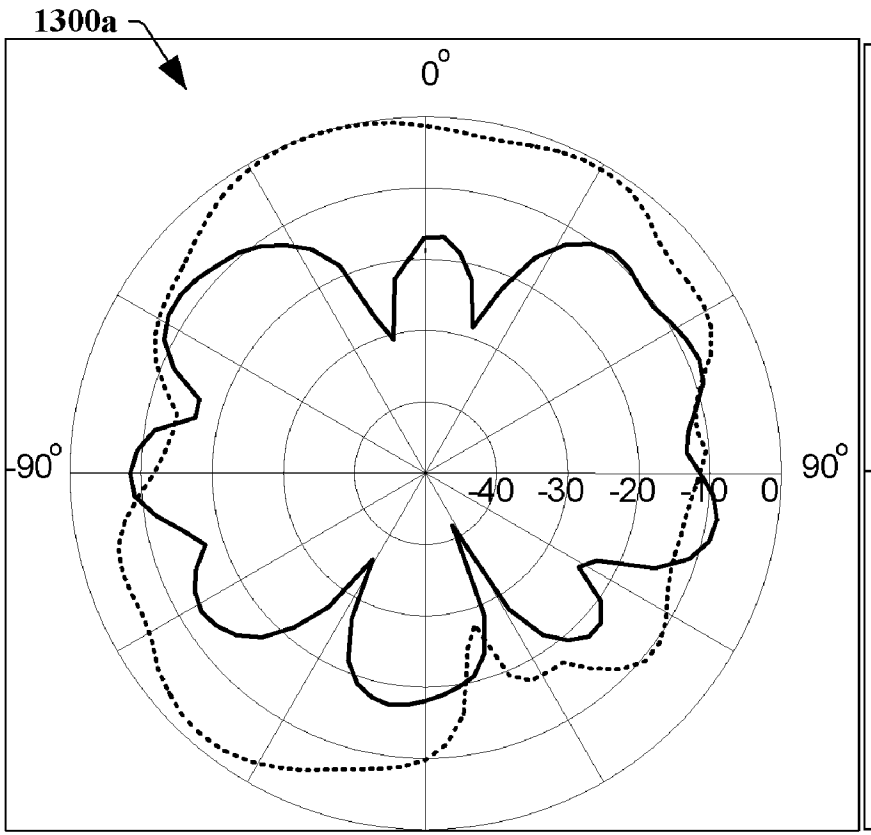
E-theta
E-phi
FIG. 13a
FIG. 13b

MULTIPLE-INPUT-MULTIPLE-OUTPUT WIRELESS COMMUNICATIONS CUBE ANTENNAS

CROSS-REFERENCE TO RELATED APPLICATIONS

This application claims the benefit of priority under 35 U.S.C Section 119 from U.S. Provisional Patent Application Ser. No. 60/942,591 entitled "MULTIPLE-INPUT-MULTIPLE-OUTPUT WIRELESS COMMUNICATIONS CUBE ANTENNAS", filed on Jun. 7, 2007, the entirety of which is incorporated herein by reference.

TECHNICAL FIELD

The subject disclosure relates to antenna designs, systems, and methods in a multiple-input-multiple-output environment.

BACKGROUND

Multiple-input-multiple-output (MIMO) wireless communication has the potential to significantly increase communication system capacity without requiring increases in transmitting power or spectrum. If M transmit and M receive antennas are used in a Rayleigh flat-fading communication environment, a theoretical linear M scale increase in channel capacity can be achieved. One challenge of MIMO wireless communication systems is the construction of compact MIMO antennas in order to be incorporated within the shrinking dimensions of communication devices.

Although a number of compact MIMO antennas consisting of up to 4 ports (including designs based on planar inverted F antennas (PIFAs) and patch antennas) have been proposed, compact antenna designs with more than 10 ports are less common and mainly consist of a flat panel approach used in base-stations. Additionally, although MIMO antennas have been developed using a cube configuration, such antennas have used up to 12 electrical dipole antennas on its 12 edges.

One advantage of a MIMO cube configuration is that, in a rich scattering environment, the MIMO cube takes advantage of spatial and polarization diversities in a compact volume. Although further increases in the number of antennas on a cube can further increase the theoretical channel capacity, it can also produce high mutual coupling between individual antennas, leading to increasing correlation and decreasing capacity.

The above-described deficiencies are merely intended to provide an overview of some of the problems encountered in implementing high capacity compact antennas, and are not intended to be exhaustive. Other problems with the state of the art may become further apparent upon review of the description of the various non-limiting embodiments of the disclosed subject matter that follows.

SUMMARY

In consideration of the above-described deficiencies of the state of the art, the disclosed subject matter provides compact 24-port and 36-port antennas based on a cube structure. According to various non-limiting embodiments of the disclosed subject matter, the antennas can be formed by densely packing individual antennas onto a cube.

According to further non-limiting embodiments of the disclosed subject matter, the cube antennas can be made from Flame Resistant 4 (FR-4) printed-circuit-boards (PCBs), which advantageously provides a low-cost easy-to-fabricate antenna construction method. According to further non-limiting embodiments of the disclosed subject matter, the 24 and 36-port cubes can be constructed using slot antennas, where slot antennas are distributed on the edges and faces of cubes. Various embodiments of the disclosed subject matter can achieve both spatial and polarization diversity.

One potential application for cube antennas is in multiple-input-multiple-output wireless communication systems, where channel capacity is a key consideration.

A simplified summary is provided herein to help enable a basic or general understanding of various aspects of exemplary, non-limiting embodiments that follow in the more detailed description and the accompanying drawings. This summary is not intended, however, as an extensive or exhaustive overview. The sole purpose of this summary is to present some concepts related to the various exemplary non-limiting embodiments of the invention in a simplified form as a prelude to the more detailed description that follows.

BRIEF DESCRIPTION OF THE DRAWINGS

MIMO cube antenna designs, systems, and methods are further described with reference to the accompanying drawings in which:

FIGS. 13*a*-13*d* illustrate measured radiation patterns of an exemplary non-limiting embodiment of a 36-port MIMO cube at 2.8 GHz in the x-z plane (1300*a*) at Port x1, in the y-z plane (1300*b*) at Port x1, in the x-z plane (1300*c*) at Port z5, and in the y-z plane (1300*d*) at Port z5, according to one aspect of the disclosed subject matter;

DETAILED DESCRIPTION

Overview

Simplified overviews are provided in the present section to help enable a basic or general understanding of various aspects of exemplary, non-limiting embodiments that follow in the more detailed description and the accompanying drawings. This overview section is not intended, however, to be considered extensive or exhaustive. Instead, the sole purpose of the following embodiment overviews is to present some concepts related to some exemplary non-limiting embodiments of the disclosed subject matter in a simplified form as a prelude to the more detailed description of these and various other embodiments of the disclosed subject matter that follow. It is understood that various modifications may be made by one skilled in the relevant art without departing from the scope of the disclosed subject matter. Accordingly, it is the intent to include within the scope of the disclosed subject matter those modifications, substitutions, and variations as may come to those skilled in the art based on the teachings herein.

Figure 1:
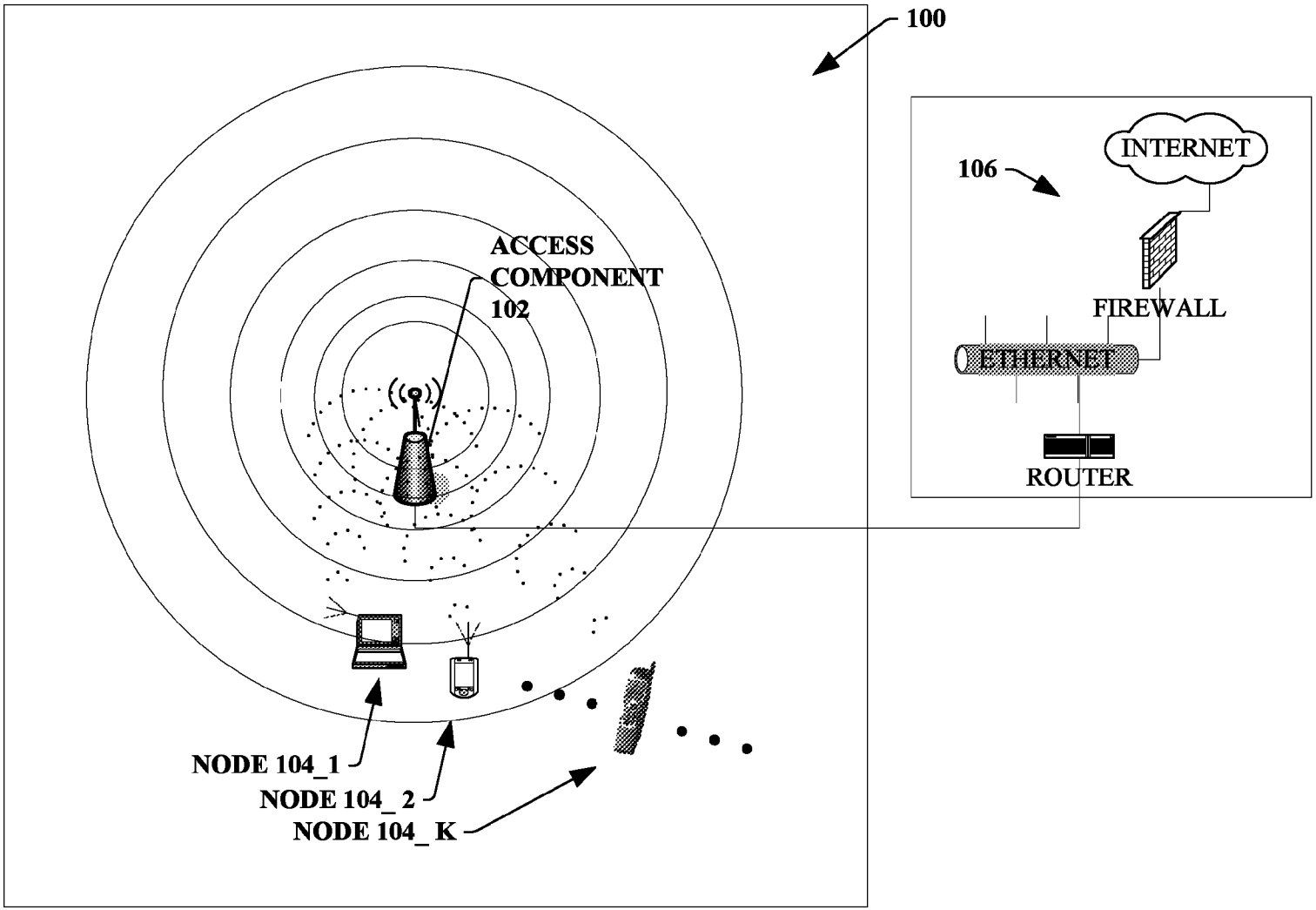
FIG. 1 illustrates an overview of a wireless communication environment suitable for incorporation of embodiments of the disclosed subject matter.

FIG. 1 is an exemplary, non-limiting block diagram illustrating a wireless communication environment 100 suitable for incorporation of embodiments of the disclosed subject matter. Wireless communication environment 100 contains a number of nodes 104 operable to communicate with a wireless access component 102 over a wireless communication medium and according to an agreed protocol. Thus, nodes 104 and/or access component 102 can include one or more of the embodiments of the disclosed subject matter and/or equivalents or portions thereof. FIG. 1 illustrates that there can be any arbitrary integral number of nodes, and it can be appreciated that due to variations in transmission path, node characteristics, scattering environment, and other variables, the disclosed subject matter is well-suited for use in such a diverse wireless communication environment. Optionally, the access component 102 may be connected to other suitable network and or wireless communication systems as described below with respect to FIGS. 19-21.

In consideration of the above-described limitations of conventional MIMO antenna designs, in accordance with exemplary, non-limiting embodiments, the disclosed subject matter provides 24-port and 36-port cube antennas in which the basic antenna elements comprise combinations of quarter-wave ($\lambda_o/4$) slot antennas and half-wave ($\lambda_o/2$) slot antennas. Details of the designs and proposed slot antennas and methods of reducing mutual coupling are described in detail below.

According to various non-limiting embodiments of the disclosed subject matter, the cube antennas can be made from FR-4 printed-circuit-boards (PCB), which advantageously provides a low-cost easy-to-fabricate antenna construction method 1600, which is further described below with respect to FIG. 16. According to further non-limiting embodiments of the disclosed subject matter, the 24 and 36-port cubes can be constructed using slot antennas, where slot antennas are distributed on the edges and faces of cubes. Various embodiments of the disclosed subject matter can achieve both spatial and polarization diversity.

In one aspect of the disclosed subject matter, a 24-port antenna cube is provided having a volume of $0.72\lambda_o^3$, while a further aspect provides a 36-port antenna having a volume of $1.13\lambda_o^3$. Advantageously, although the individual antennas are densely packed, most combinations of mutual couplings between ports exhibit better than −20 decibel (dB) isolation according to various non-limiting embodiments of the disclosed subject matter.

In one embodiment of the disclosed subject matter, a 24-port cube antenna can comprise cross-polarized quarter-wave slots at the cube edges advantageously providing polarization diversity on every edge of the cube and both spatial and polarization diversities on the entire structure, which leads to good isolation. For the 24-port cube, 12 pairs of quarter-wave ($\lambda_o/4$) slot antennas can be distributed on the edges of a cube providing low mutual coupling within a comparable volume. In one aspect, the 24 antennas can be built on an 80 (cubic millimeter) $mm^3$ cube with an operating frequency of 2.70 GHz.

According to a further embodiment, an additional 6 pairs of half-wave ($\lambda_o/2$) slot antennas can be placed on the surfaces of the cube to provide 12 extra ports to form a 36-port antenna.

According to a further embodiment, the disclosed subject matter provides a 36-port MIMO antenna comprising a combination of 24 half-wave slot antennas and 12 quarter-wave slot antennas. Two $\lambda_o/2$ slot antennas can be integrated together orthogonally sharing an edge of the cube, while another two $\lambda_o/4$ slot antennas can be printed on the face of the cube with a pair of L-stubs for suppressing mutual coupling. In one aspect of the disclosed subject matter, the 36 antennas can be built on a 120 $mm^3$ cube with the operating frequency of 2.82 GHz.

One potential application for the cube antennas is in multiple-input-multiple-output wireless communication systems, where channel capacity is a key parameter to be considered. Results show that the average mutual couplings among the ports better than −20 dB can be achieved, leading to good channel capacity in MIMO applications. Accordingly, the expected channel capacity of a 36-port cube with both mutual coupling and channel correlation considered is 157 bits/second/Hertz (b/s/Hz) at a signal-noise-ratio (SNR) of 20 dB per receiver branch compared to an ideal channel capacity of 197 b/s/Hz, as shown by simulation and measurement of a particular embodiment of the disclosed subject matter.

DETAILED DESCRIPTION

24-Port Antenna Cube

Figure 2:
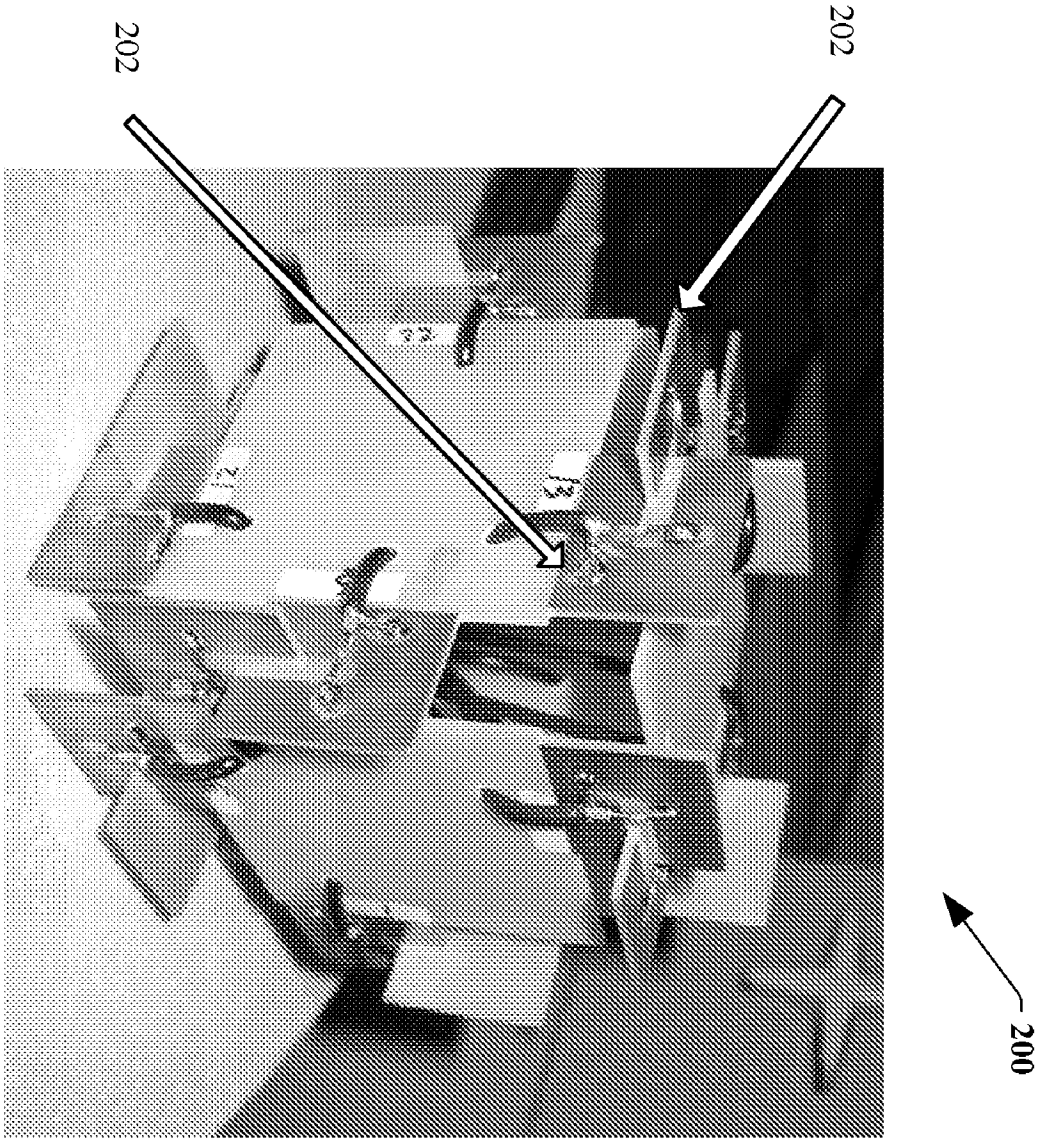
FIG. 2 depicts a 24-port MIMO cube according to one aspect of the disclosed subject matter.

FIG. 2 depicts a 24-port MIMO cube 200 according to one aspect of the disclosed subject matter. In a particular non-limiting embodiment, the disclosed subject matter provides a 24-port MIMO cube antenna 200 that can comprise 12 pairs of $\lambda_o/4$ slot antennas 202 distributed on the 12 edges of a cube having an overall volume of approximately 80×80×80 cubic meters ($mm^3$) or equivalently 27.7 $mm^3$ per port. In a further aspect of the disclosed subject matter, the fundamental antenna element in the structure comprises a $\lambda_o/4$ slot design as exemplified in FIGS. 3*a* and 3*b*.

Figure 3B:
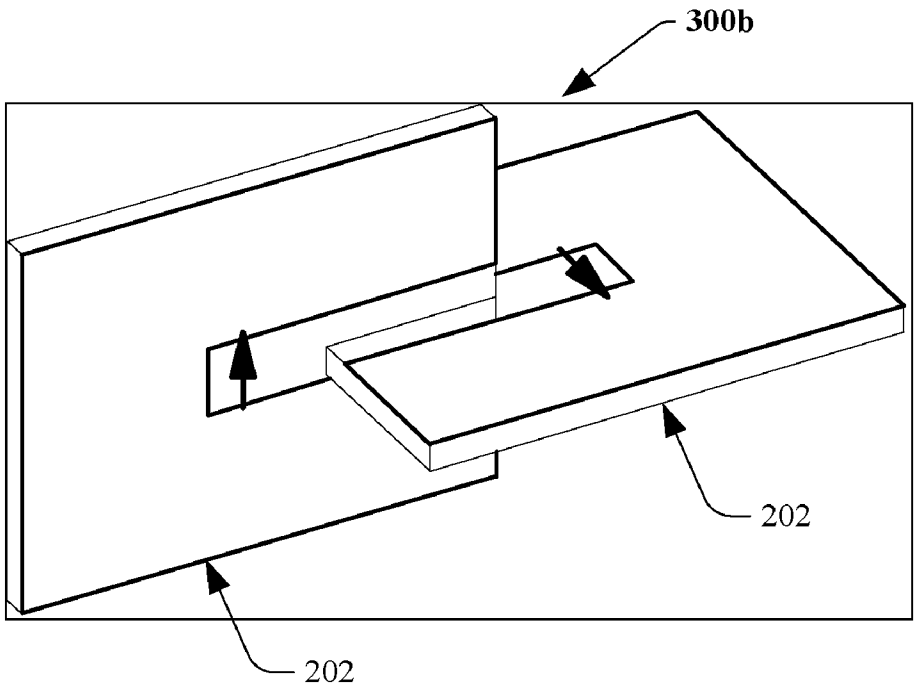
FIGS. 3*a* and 3*b* illustrate an exemplary non-limiting geometry of a quarter-wave slot antenna for a single antenna (300*a*) and a pair of antennas (300*b*) slid in cross position (units are shown in millimeters), according to one aspect of the disclosed subject matter.
Figure 3A:
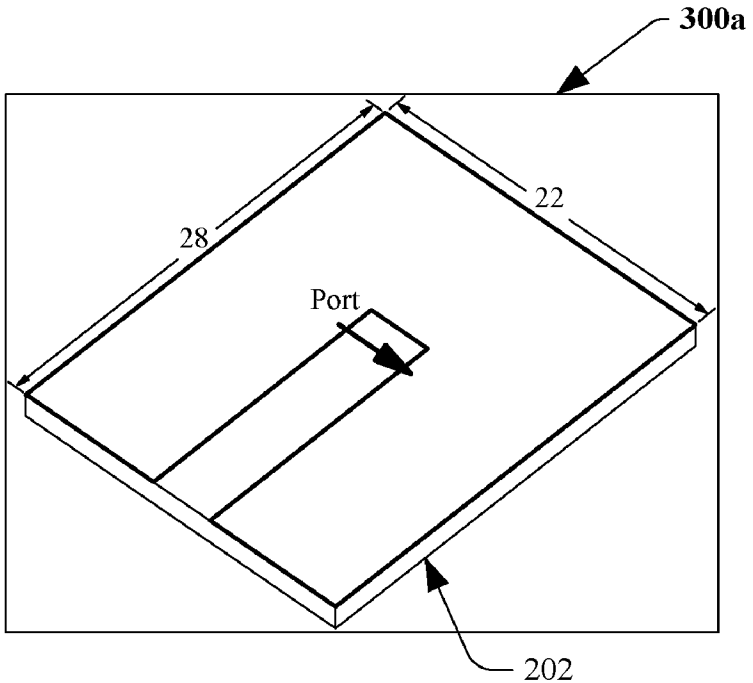

FIGS. 3*a* and 3*b* illustrate an exemplary non-limiting geometry of a quarter-wave slot antenna 202 for a single antenna 300*a* and a pair 300*b* of antennas 202 slid in cross position (units are shown in millimeters), according to one aspect of the disclosed subject matter. The $\lambda_o/4$ slot antenna 202 can be thought of as being formed from a typical $\lambda_o/2$ rectangular slot cut into a flat metal sheet. However, according to one aspect of the disclosed subject matter, the slot can be shortened to $\lambda_o/4$ by noting that the end of an $\lambda_o/2$ slot can be thought of as a short-circuit and can therefore be transformed to an open-circuit when viewed a quarter-wave electrical length along at approximately the middle of the slot. As a result, the $\lambda_o/4$ slot antenna can be formed with one open-end as shown in FIG. 3*a*.

According to a further aspect of the disclosed subject matter, $\lambda_o/4$ slot antenna 202 can comprise a single-sided FR-4 PCB with dielectric constant of approximately 4.6 and thickness of approximately 1.6 mm with dimensions as shown in FIG. 3*a*. Advantageously, the resonant frequency of the antenna can be shifted downward by placing the antenna substrate at the back side of the metal sheet and slot to provide a resonant frequency of around 2.7 GHz. According to a further aspect of the disclosed subject matter, the slot size of 17×4 $mm^2$ can be scratched out on the metal layer.

In order to match the antenna to a 50-Ω (ohm) system, a coaxial feed can be connected 2 mm away from the shorted edge of the slot, according to a further aspect of the disclosed subject matter. Additionally, one end of the coaxial cable can be terminated with a SubMiniature version A (SMA) connector, while the other end can be soldered with a 15 mm long copper stick forming a more rigid probe feed for the antenna according to a further aspect of the disclosed subject matter.

Figure 16:
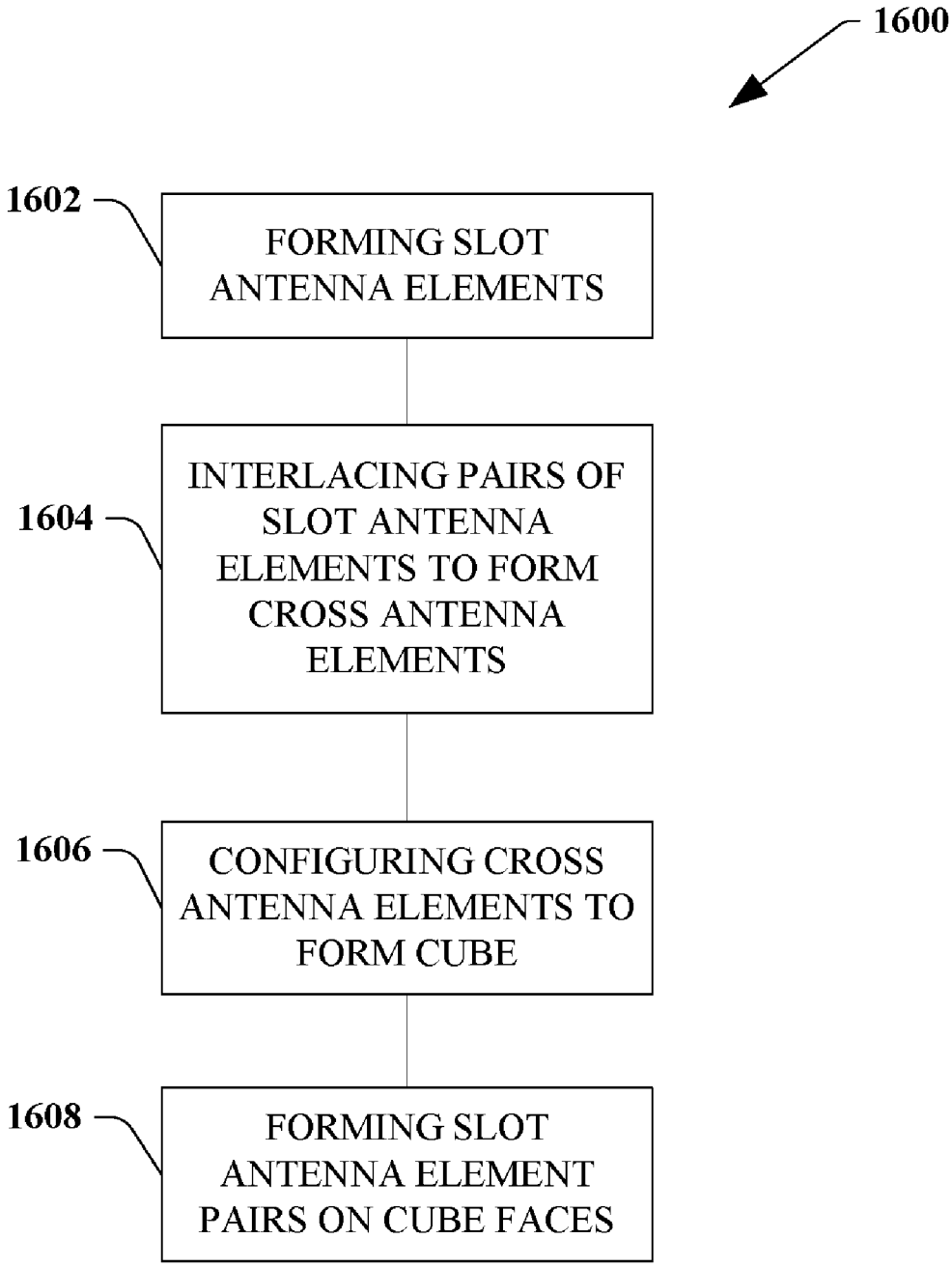
FIG. 16 illustrates an exemplary non-limiting block diagram of a method for constructing MIMO cube antennas according to various aspects of the disclosed subject matter.

With reference to FIG. 16, according to various non-limiting embodiments the disclosed subject matter provides a convenient method of construction 1600 of the cube antenna, comprising forming 1602 the slot antenna elements (e.g., 202, etc.), interlacing 1604 together two $\lambda_o/4$ slot antenna elements 202 to form a "cross" thereby, and causing the slot antenna elements to share a part of their common space along their centre line as shown 300*b* in FIG. 3*b*. Advantageously, one method of construction of the cross structure additionally comprises forming an additional slit with length 5 mm and width 1.6 mm on one end of each antenna so that the antenna elements can be slid into position, according to various non-limiting embodiments of the disclosed subject matter.

As a further advantage, even though the two slot antennas are substantially close together, the isolation can be maintained around −20 dB, due in part to the feeds being orthogonal to each other and both antennas having different polarizations. According to further non-limiting embodiments of the disclosed subject matter, one construction method further comprises configuring 1606 the slot antenna element pairs (e.g., 300*b*, etc.) on the edges of a cube-like structure (e.g., a cube) 200 to provide both spatial and polarization diversities arising from the spatial separation and distribution of antennas across the x, y and z axes forming the cube-like structure as shown in FIG. 2.

It is understood that various modifications can be made by one skilled in the relevant art without departing from the scope of the disclosed subject matter. Accordingly, it is the intent to include within the scope of the disclosed subject matter those modifications, substitutions, and variations as may come to those skilled in the art based on the teachings herein.

DETAILED DESCRIPTION

36-Port Antenna Cube

Figure 4:
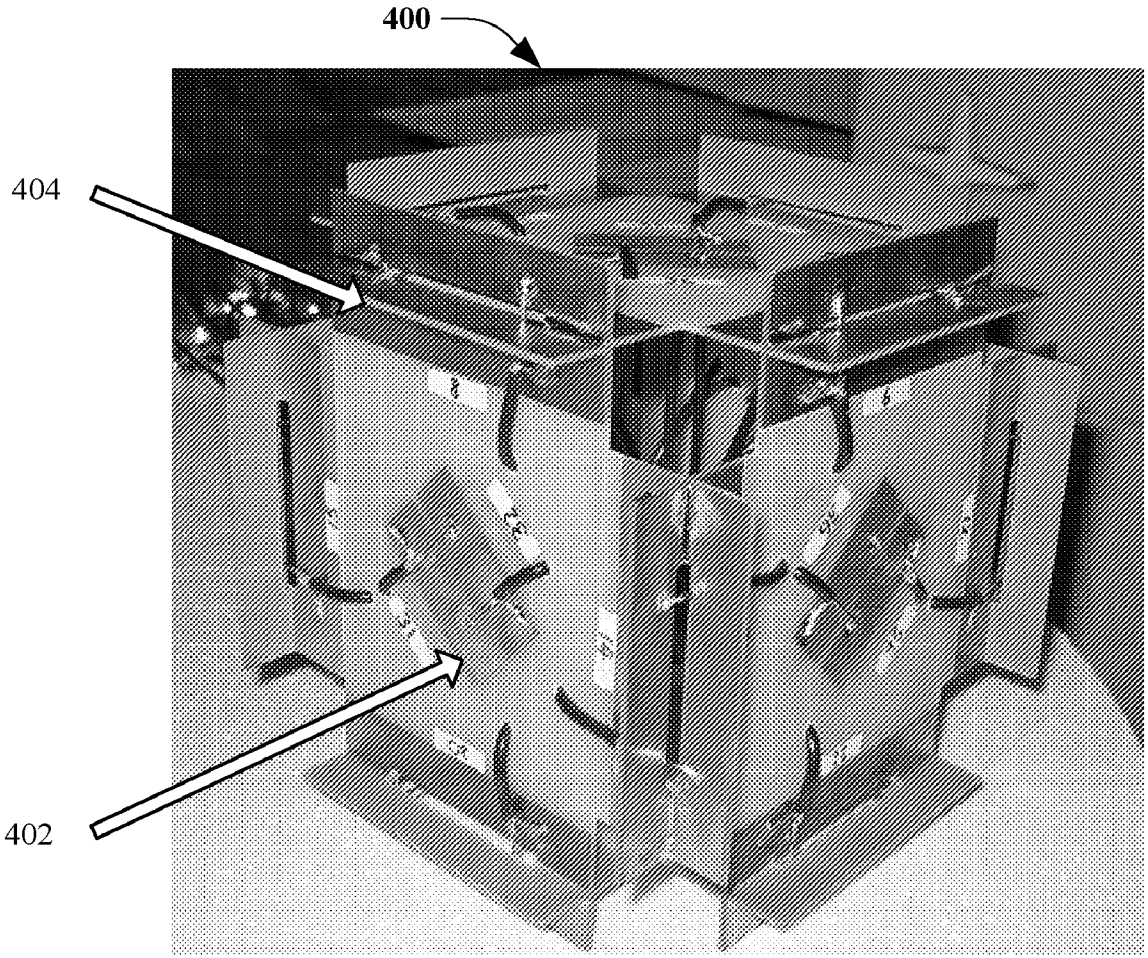
FIG. 4 depicts a 36-port MIMO cube according to one aspect of the disclosed subject matter.

FIG. 4 depicts a 36-port MIMO cube 400 according to further aspects of the disclosed subject matter. In this regard, the disclosed subject matter provides a 36-port antenna cube 400 that follows similar principles of construction as the 24-port design 200. Accordingly, an antenna cube can include 12 more antenna ports (e.g. in 6 pairs 402 of antenna elements) on the 6 faces of a cube 400 having an overall volume of the antenna of approximately 120×120×120 $mm^3$ or equivalently 36.3 $mm^3$ per port. In a further aspect of the disclosed subject matter, the fundamental edge antenna element can be modified from an $\lambda_o/4$ slot 202 to an $\lambda_o/2$ slot 404. According to further non-limiting embodiments of the disclosed subject matter, 24 half-wave slot antennas (e.g., in 12 pairs 404 of antenna elements) and 12 quarter-wave slot antennas with L-stubs (e.g. in 6 pairs 402 of antenna elements) can be distributed on the edges and faces of the cube, respectively. According to a further aspect of the disclosed subject matter, the $\lambda_o/4$ slot antennas 402 can be arranged to have a 45 degree rotation relative to the $\lambda_o/2$ slot antennas 404, advantageously reducing mutual couplings among the antennas.

Referring again to FIG. 16, according to various non-limiting embodiments, the disclosed subject matter provides a convenient method of construction 1600 of the cube antenna 400, comprising forming 1602 12 pairs 404 of 24 half-wave slot antenna elements 1604 similar manner as described above for the $\lambda_o/4$ slot antennas of the particular non-limiting embodiment of the 24-port cube antenna design 200 and method of construction 1600 in FIGS. 2-3 and 16.

Figure 5:
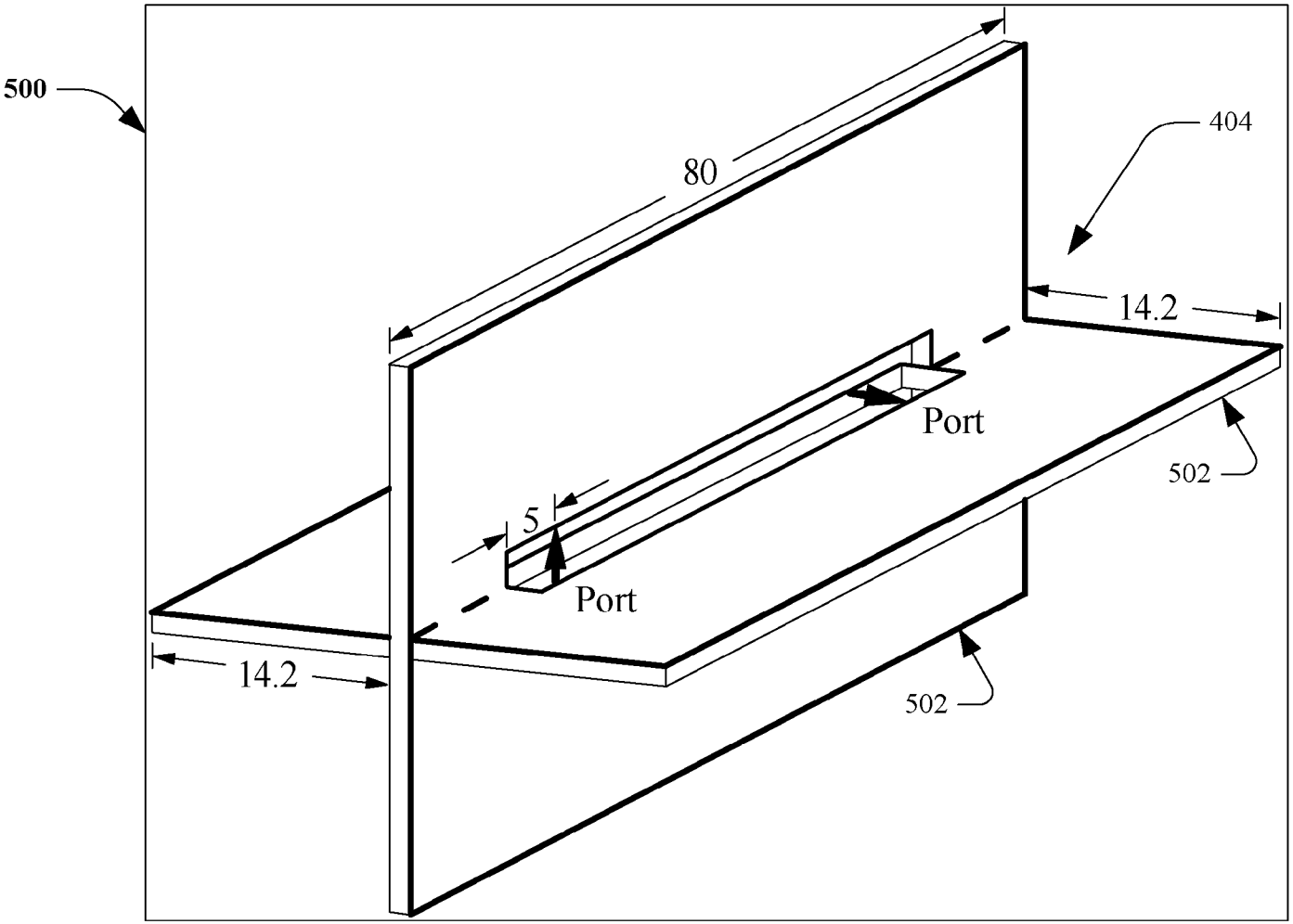
FIG. 5 illustrates an exemplary non-limiting geometry of a cross half-wave slot antenna (units are shown in millimeters), according to one aspect of the disclosed subject matter.

FIG. 5 illustrates an exemplary non-limiting geometry 500 of a cross half-wave slot antenna 404 (units are shown in millimeters), according to one aspect of the disclosed subject matter. Therein, two substantially identical $\lambda_o/2$ slot antennas 502 can be interlaced 1604 together forming a "cross," thereby, and causing the slot antenna elements 502 to share a part of their common slot along their centre line as shown in FIG. 5.

According to a further aspect of the disclosed subject matter, the slot antenna element 502 can be made 1602 of single-sided FR-4 PCB and a slot with metal sheet and substrate of approximately 48×6 $mm^2$ can be milled out in the middle of the board. Advantageously, one method 1600 of construction of the cross structure additionally can comprises forming 1602 an additional slit with width approximately 1.6 mm on one end of each antenna so that the antenna elements can be slid into position, according to various non-limiting embodiments of the disclosed subject matter. Additionally, the antenna element 502 feed can be located approximately 5 mm away from the edge of the slot with the feed locations located on opposite ends of the common slot to advantageously keep the feed currents separate, According to further non-limiting embodiments of the disclosed subject matter, the antennas can be designed to operate at around 2.8 GHz.

As a further advantage, the two slot antennas 502 can be fed orthogonally and can be highly polarized, which, although sharing the same space, isolation can be kept below −15 dB, according to various non-limiting embodiments of the disclosed subject matter. According to further non-limiting embodiments of the disclosed subject matter, a construction method 1600 can comprise configuring 1606 the slot antenna element pairs 404 of on the edges of a cube-like structure (e.g., a cube) 400 to provide both spatial and polarization diversities as a result of separating and distributing the antennas 404 on x, y and z axes forming a cube 400 as shown in FIG. 4.

According to further non-limiting embodiments of the disclosed subject matter, one construction method 1600 can further comprise forming 1608 12 additional antennas 402 on the cube faces for the 36-port cube design to keep mutual coupling low. As described above, when more antennas are closely-packed in a confined volume, mutual coupling becomes a serious problem. One of the obvious solutions is to increase the separations between antennas, but this will lower the spatial efficiency.

To the foregoing and related ends, a convenient method for suppressing mutual coupling of a pair of $\lambda_o/4$ slot antennas 402 is provided according to further non-limiting embodiments of the disclosed subject matter. Accordingly, the construction method 1600 can further comprise locating a pair of L-stubs to improve the isolation of a closed pair slot antennas.

Figure 6:
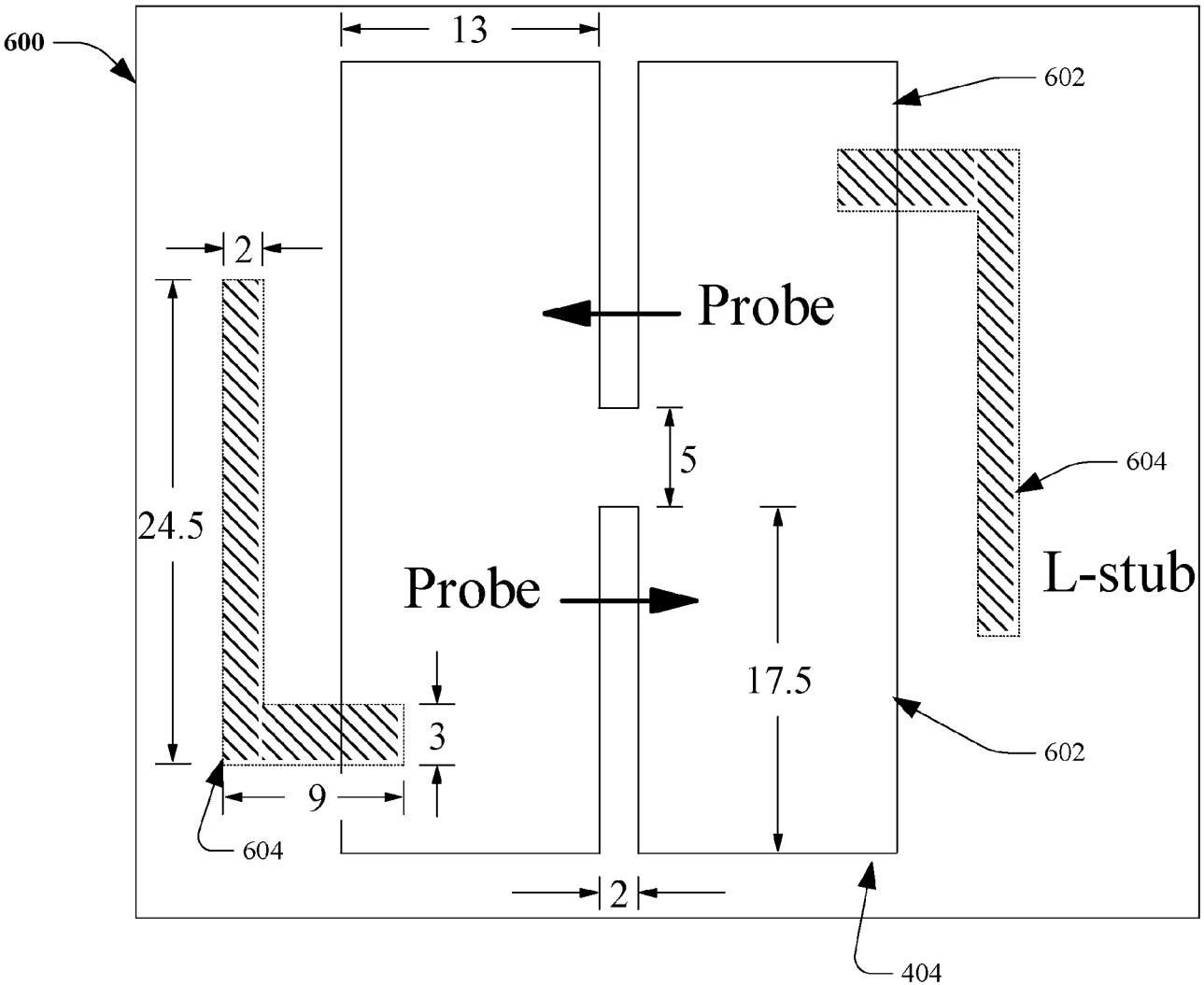
FIG. 6 illustrates an exemplary non-limiting geometry of a pair of quarter-wave slot antennas with L-stubs at the back side of an antenna PCB (units are shown in millimeters), according to one aspect of the disclosed subject matter.

FIG. 6 illustrates an exemplary non-limiting geometry 600 of a pair of quarter-wave slot antennas 602 with L-stubs 604 at the back side of an antenna element PCB (units are shown in millimeters), according to one aspect of the disclosed subject matter. FIG. 6 shows a closed pair slot antenna "H-shape" structure 404 located adjacent to a pair of L-stubs 604. As depicted in FIG. 6, the L-stubs 604 are shown filled in with hashes to indicate that the L-stubs are located in a separate physical plane from the closed pair slot antenna "H-shape" 404, (e.g., printed on two different sides of a FR-4 PCB). According to further non-limiting embodiments of the disclosed subject matter, the areas of the substrate right under the slots can be retained (e.g., not milled out), in a similar way to the particular non-limiting embodiment of the 24-port Antenna Cube 200 described above. In a further aspect of the disclosed subject matter, the feed location of the $\lambda_o/4$ slot antenna 602 can be located 5 mm away from the short-circuit end. Advantageously, when the two slot antennas are excited simultaneously, part of the field is coupled to L-stubs 604 to spread out the surface current over the entire metal sheet. Without such L-stubs 604, the surface current can be more confined to the edges of the radiating slots, thus increasing the couplings between two near slot antennas. According to various non-limiting embodiments of the disclosed subject matter, more than 6 dB isolation improvement can be obtained by introducing a pair of L-stubs 604.

Figure 7:
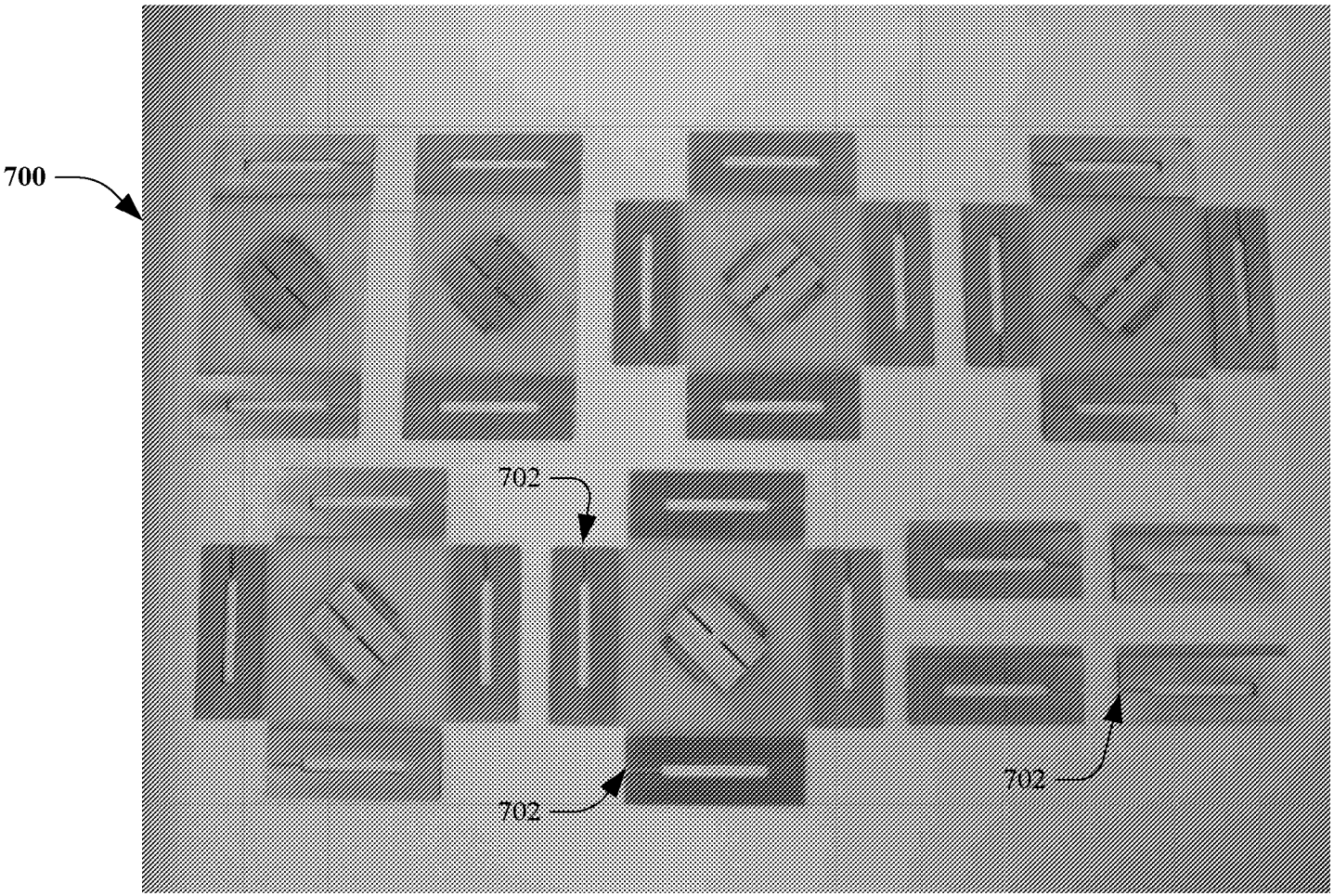
FIG. 7 depicts an exemplary non-limiting compliment of ten component PCBs of a 36-port MIMO cube, according to one aspect of the disclosed subject matter.

FIG. 7 depicts an exemplary non-limiting compliment of ten component PCBs of a 36-port MIMO cube, according to one aspect of the disclosed subject matter. According to further non-limiting embodiments of the disclosed subject matter, one method of construction 1600 comprises forming 1602 the cube antenna using 10 pieces of FR-4 PCBs as depicted in FIG. 7. To build up all PCBs together to form a cube, the method further comprises forming 1602 an accurate slit 702 width of approximately 1.6 mm (e.g., same as the thickness of PCBs) to allow for interlacing 1604 of the PCB's to form the cross slot antennas (e.g., 404, etc.). As a result, all, or substantially all, PCB layouts can advantageously be milled out automatically by a computer. According to further non-limiting embodiments of the disclosed subject matter, the method can further comprise etching 1602 the antenna patterns on the PCBs after milling. The cube antenna can then be easily formed by interlacing 1604 or sliding up all PCBs together along the slit (e.g., an approximately 1.6 mm slit or same dimension as the thickness of PCBs), resulting in a rigid antenna without the help of any supporting material. Advantageously, the disclosed method reduces fabrication complexity and cost.

It is understood that various modifications may be made by one skilled in the relevant art without departing from the scope of the disclosed subject matter. For example, suitable alternatives to the disclosed materials can be used or substituted. As a further example, physical dimensions including, but not limited to, linear and angular dimensions, either absolute or relative to relevant points of reference, can be varied according to design considerations. For instance, variations in physical dimensions can be made to tune the disclosed embodiments according to desired system design parameters including, but not limited to, technical, economic, ergonomic, and/or aesthetic factors, or any combination thereof. Accordingly, it is the intent to include within the scope of the disclosed subject matter those modifications, substitutions, and variations as may come to those skilled in the art based on the teachings herein.

DETAILED DESCRIPTION

Measured Antenna Performance

Typical MIMO antenna performance assessments comprise essentially two kinds of measurements (e.g., conventional antenna performance and estimated channel capacity). Because there are up to 36 ports in various non-limiting embodiments of the disclosed MIMO cubes, in order to simplify the description of the possible combinations of scattering parameters (S-parameters), it is sufficient to select several antenna ports for illustration and include all the worst case results. In addition, due to the complexity in describing the possible antenna port combinations, it is necessary to provide a convenient notation so that each antenna can be easily identified so that the measurement parameters can be correctly interpreted.

Figure 8:
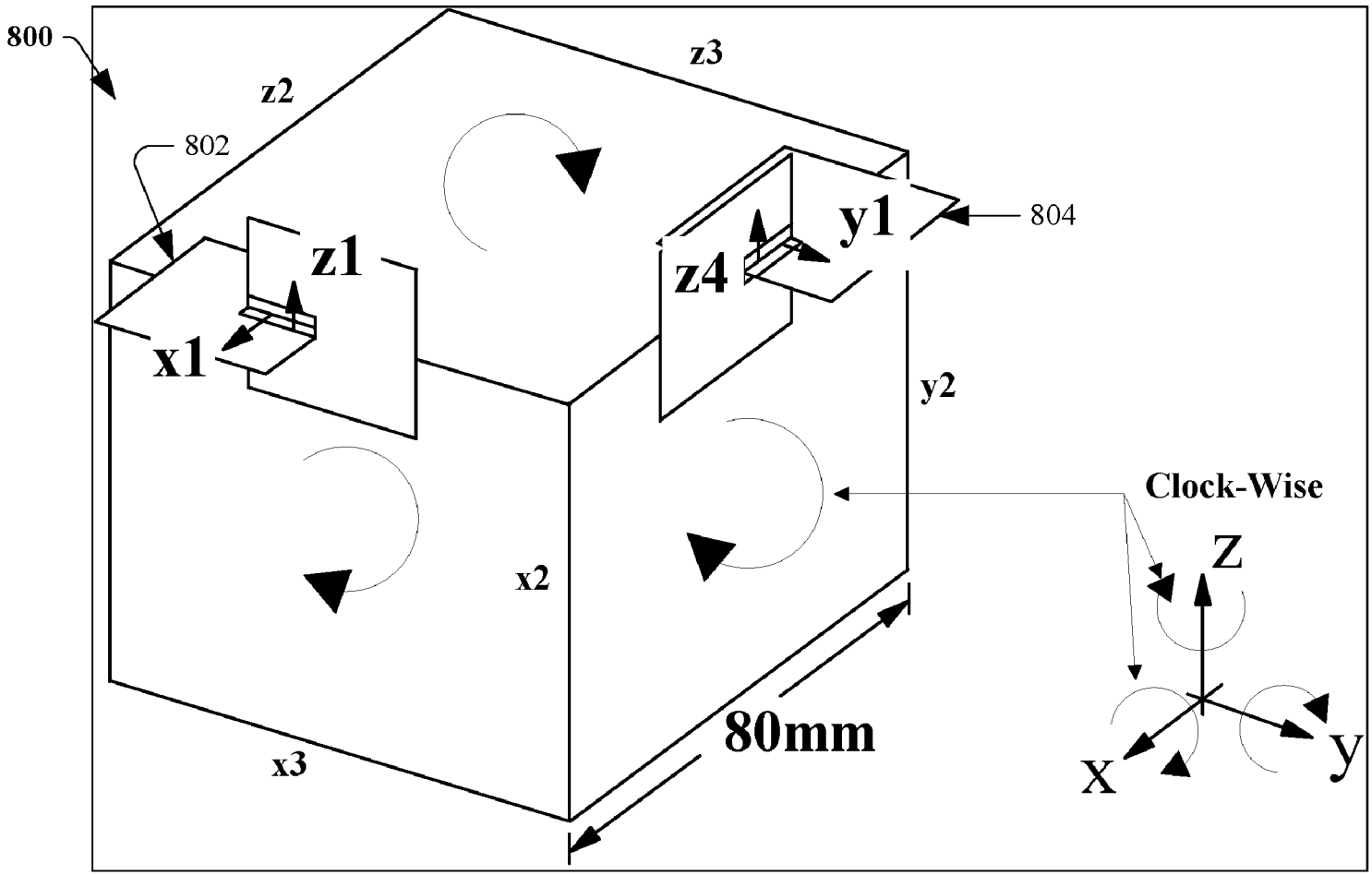
FIG. 8 is a diagram illustrating notation for port-naming convention of a simplified 24-port MIMO cube according to one aspect of the disclosed subject matter.

FIG. 8 is a diagram illustrating notation for port-naming convention of a simplified 24-port MIMO cube (e.g., 200) according to one aspect of the disclosed subject matter. The notation for a 24 port cube is shown with the x, y, and z axes also displayed. Three cube faces are labeled x, y, z as shown in FIG. 8. The 4 antennas (e.g., 300*b* only two of which (802 and 804) are shown on the z face) on each edge of a face that are parallel to an axis are then numbered 1-4 (e.g. z1, z2, z3, and z4) in a clock-wise direction (the clockwise direction is with respect to looking down the relevant axis toward the origin of the x, y, z axes). The antennas (not shown) on the three remaining hidden faces use symmetry. For example, the antenna x1 is reflected in the plane yz to form x1'. Following this notation, all 24 antennas can be identified. For example, the cross-coupling between antenna x1 and x1' is written as Sx1*x*1'. While that between x1 and y1 as Sx1*y*1.

For the evaluation of the particular non-limiting embodiment of a 24-port antenna design (e.g., 200), all ports not under test are provided with 50-Ω load terminations. For S-parameter measurements, two antennas are connected to a 2-port network analyzer each time and isolation between any two antennas can be obtained.

Figure 9:
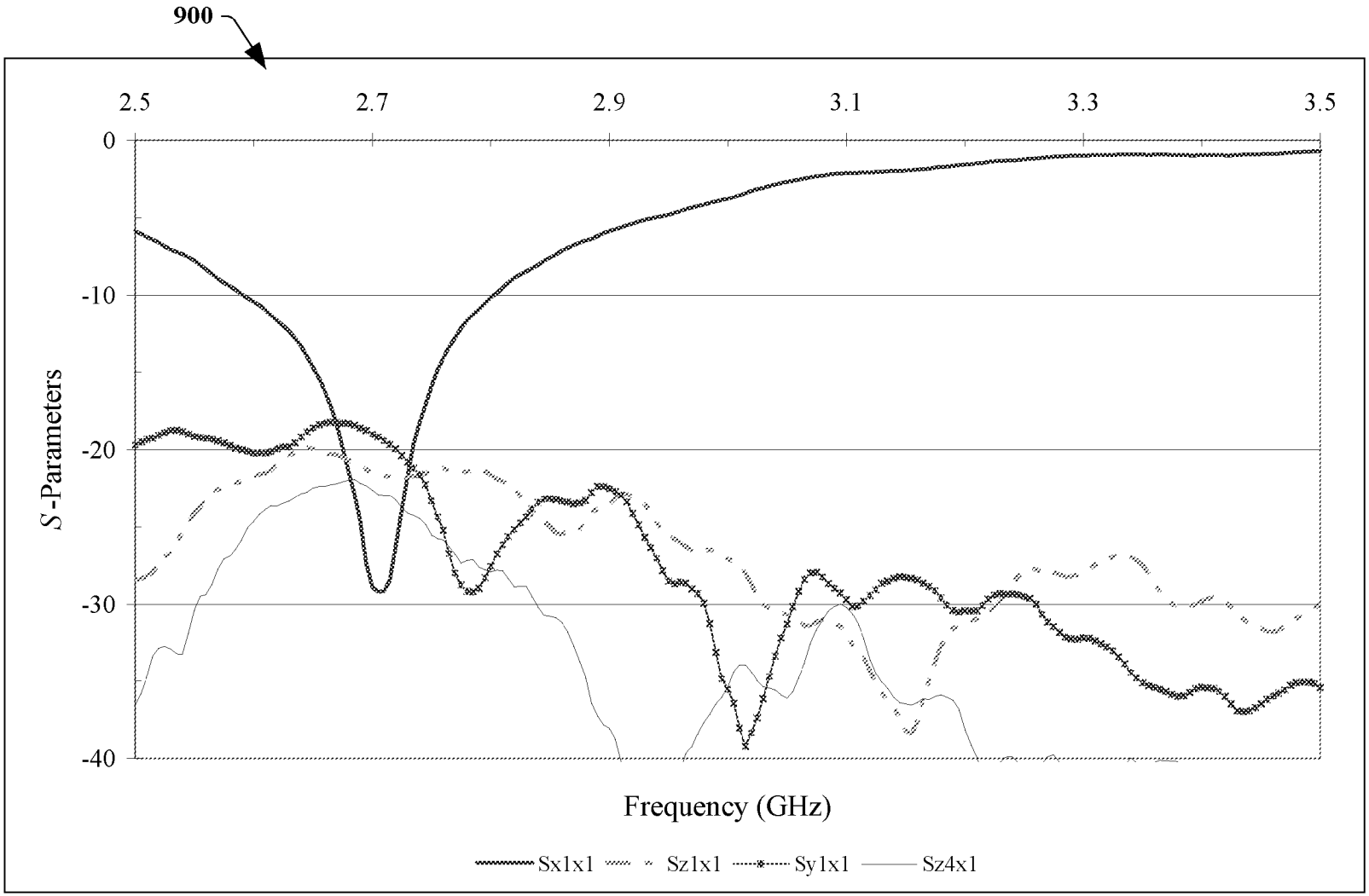
FIG. 9 illustrates measured S-parameters of an exemplary non-limiting embodiment of a 24-port MIMO cube according to one aspect of the disclosed subject matter.
Figure 10B:
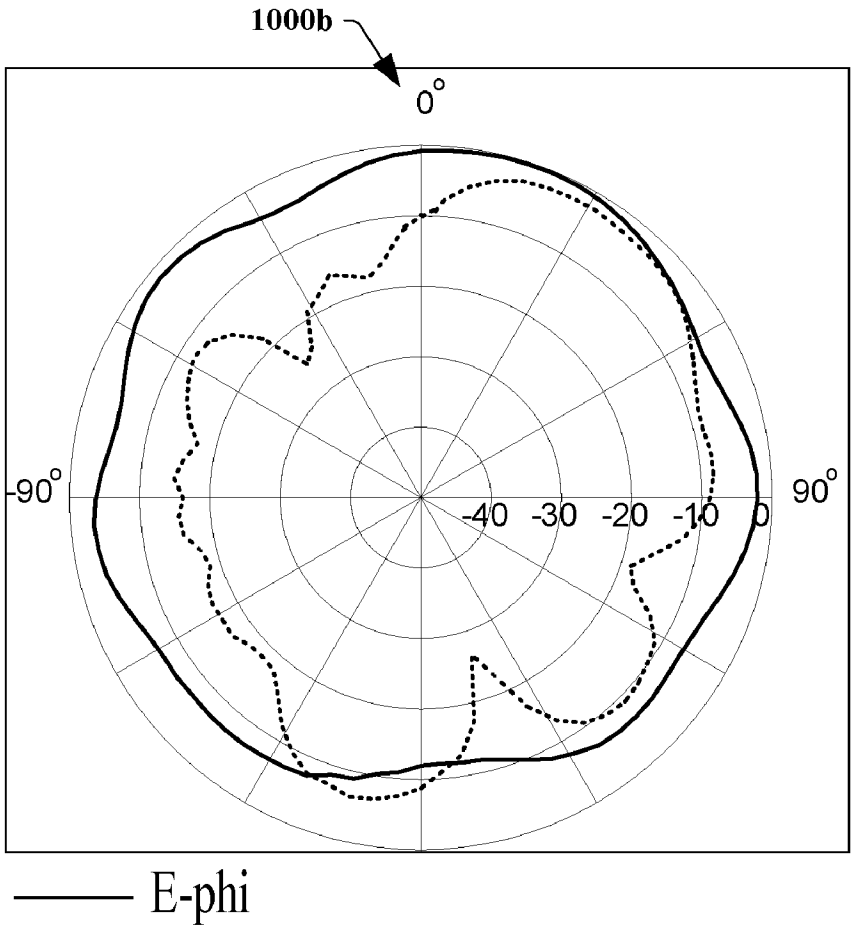
FIGS. 10*a* and 10*b* illustrate the measured radiation patterns of an exemplary non-limiting embodiment of a 24-port MIMO cube at 2.7 GigaHertz (GHz) in the x-z plane (1000*a*) at Port x1 and the y-z plane (1000*b*) at Port x1, according to one aspect of the disclosed subject matter.
Figure 10A:
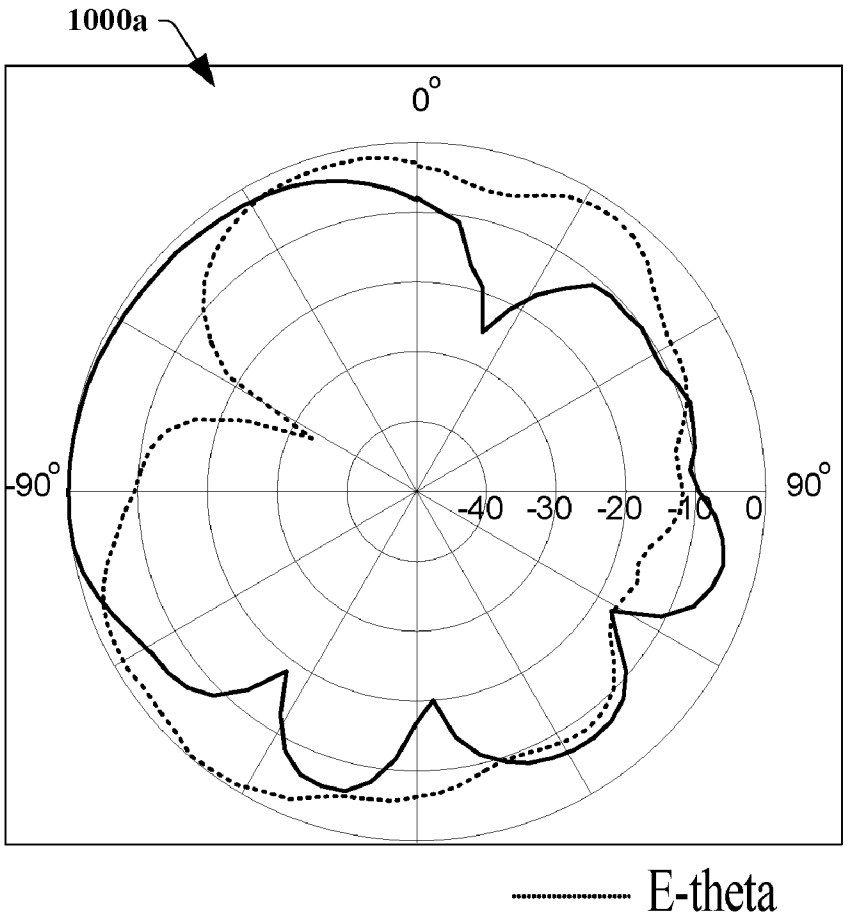

FIG. 9 illustrates the measured S-parameters of an exemplary non-limiting embodiment of a 24-port MIMO cube (e.g., 200) according to one aspect of the disclosed subject matter. Accordingly, in FIG. 9, the 24-port MIMO cube antennas are shown to operate at 2.62 GHz to 2.82 GHz, if the voltage standing wave ratio (VSWR) requirement is less than or equal to 2. The worst isolation occurs on pairs x1 and y1 and their symmetry equivalents, but it still maintains a value of at least −18.2 dB across the band. The measured radiation patterns for Port x1 in xz and yz planes are given in FIGS. 10*a* and 10*b*, whereas gain and efficiency of the Port x1 are 4.4 dBi and 62% as measured by a StarLab antenna pattern measurement device. Similar measurements are shown for a particular non-limiting embodiment of a 36-port cube antenna design (e.g., 400).

Figure 11:
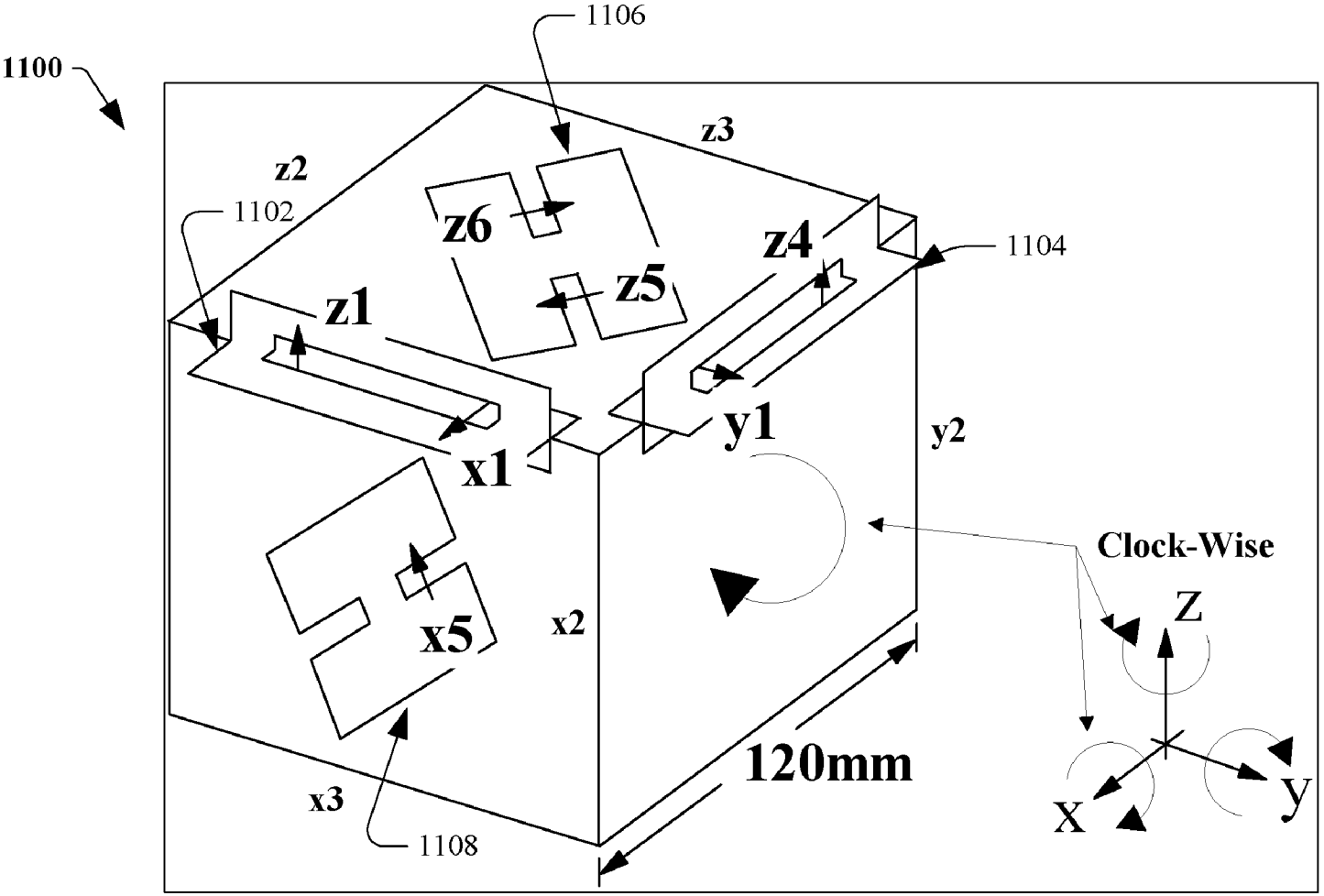
FIG. 11 is a diagram illustrating notation for port-naming convention of a simplified 36-port MIMO cube according to one aspect of the disclosed subject matter.

FIG. 11 is a diagram illustrating notation for port-naming convention of a simplified 36-port MIMO cube (e.g., 400) according to one aspect of the disclosed subject matter. The notation for the additional 12 antennas (e.g., 602) is shown in FIG. 11 where the antennas (e.g., 602) are labeled x5 and x6, y5 and y6, z5 and z6 with the remainder using reflected symmetry as in the 24-port configuration 800. Two pairs of cross $\lambda_o/2$ slot antennas (1102 and 1104) and two pairs of $\lambda_o/4$ slot antennas (1106 and 1108) are shown in FIG. 11.

Figure 12A:
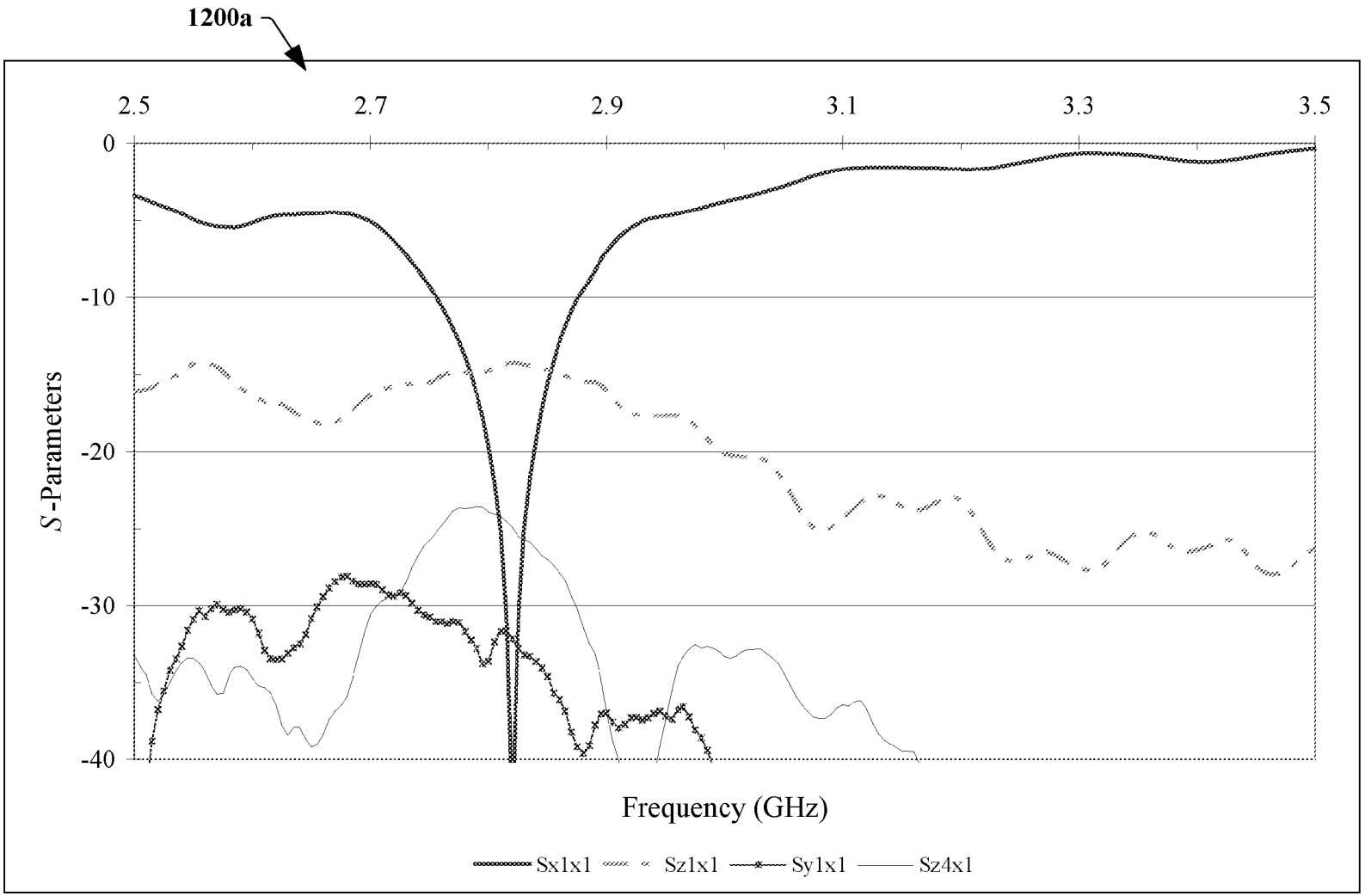
FIGS. 12*a* and 12*b* illustrate measured S-parameters of an exemplary non-limiting embodiment of a 36-port MIMO cube according to one aspect of the disclosed subject matter.
Figure 12B:
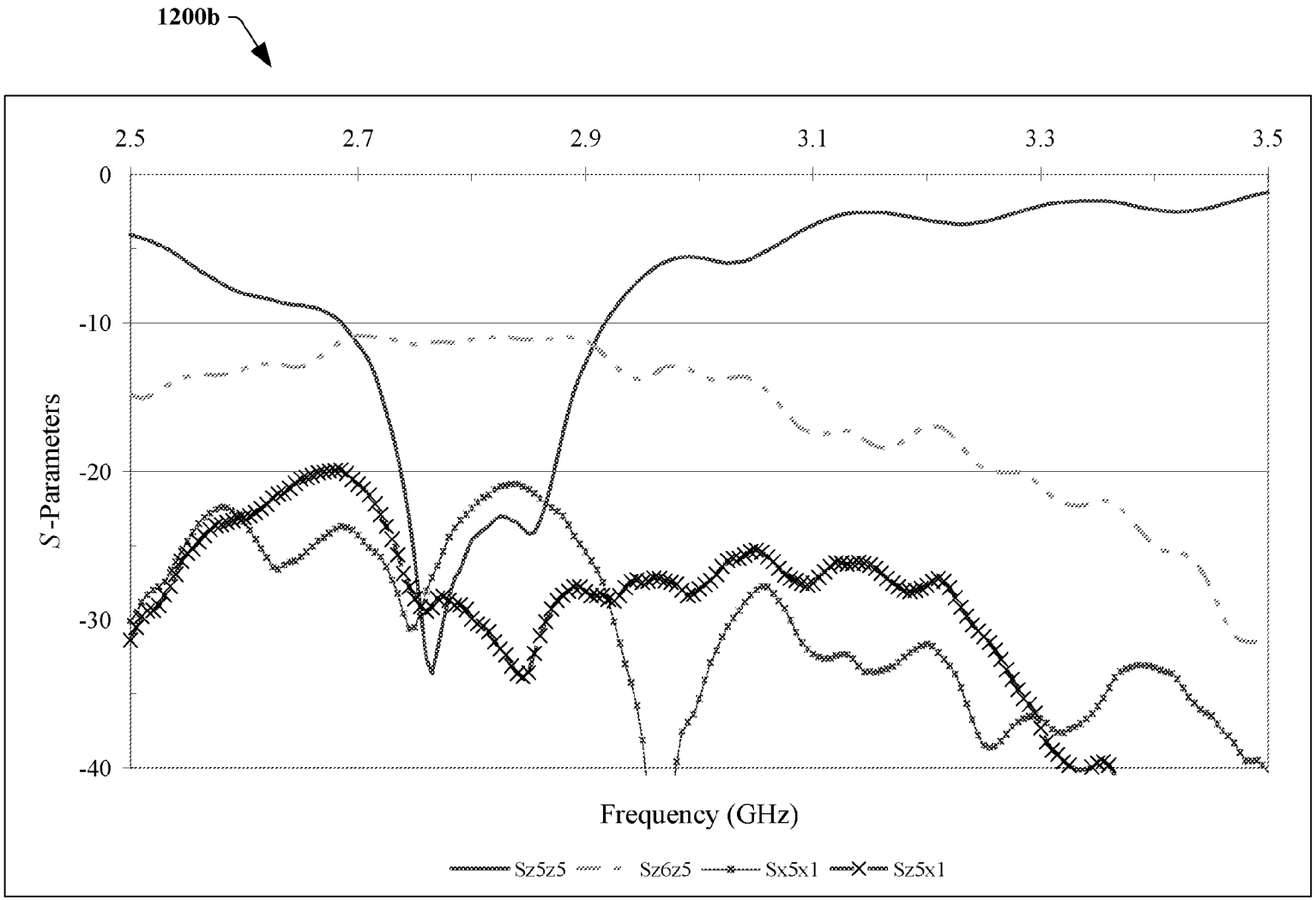
Figures 13C, 13D:
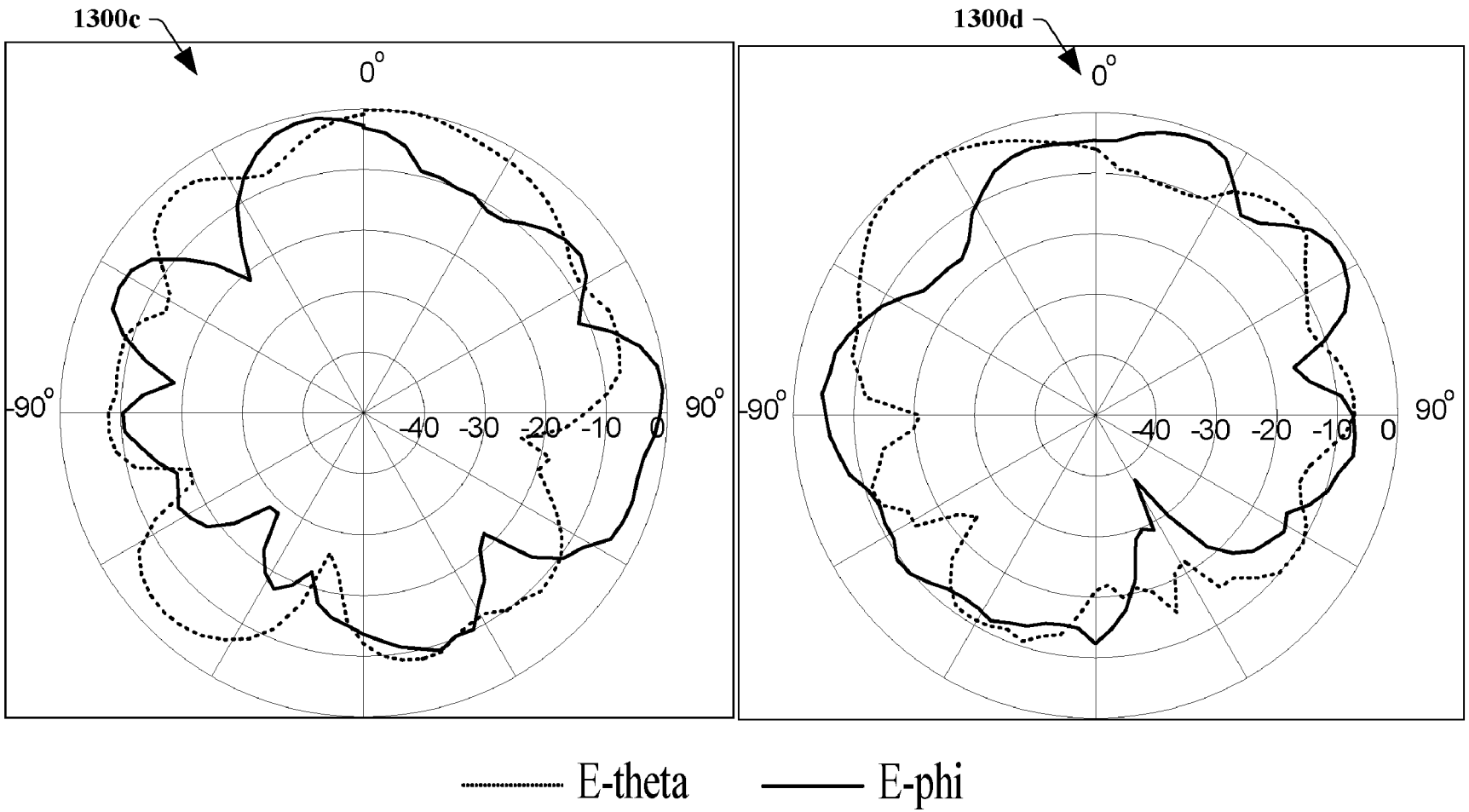

FIGS. 12*a* and 12*b* illustrates the measured S-parameters of an exemplary non-limiting embodiment of a 36-port MIMO cube (e.g., 400) according to one aspect of the disclosed subject matter. From FIGS. 12*a* and *b*, the cross $\lambda_o/2$ slot antenna and $\lambda_o/4$ slot of the 36-port cube antenna (e.g., 400) are shown to operate at 2.76 GHz to 2.87 GHz and 2.69 GHz to 2.92 GHz, respectively, if the VSWR requirement is less than or equal to 2. As shown in FIG. 12*b*, two resonances are found on Port z5 due to part of the energy generated by the $\lambda_o/4$ slot being coupled to the L-stub 604, providing an additional resonance for Port z5.

As a result, according to various non-limiting embodiments, the disclosed subject matter advantageously provides a widened antenna bandwidth by increasing the tolerance of the overall cube's bandwidth from the different antenna structures integrated onto the cube. From the measured S-parameter results, it is noted that the worst isolation pairs of FIGS. 12*a* and 12*b* are Port z1 and Port x1, and Port z5 and Port z6, which still maintain the values better than −14.3 dB and −10.9 dB, respectively. All other combinations of antenna ports, including those results not shown, have isolation better than −20 dB.

It is to be understood that the relatively low mutual couplings between antennas of the proposed MIMO cube are due mainly to the choice of antenna types, positions and orientations. Accordingly, although specific dimensions are given with respect to particular embodiments of the disclosed subject matter, it should be understood that various modifications can be made by one skilled in the relevant art without departing from the scope of the disclosed subject matter. Accordingly, it is the intent to include within the scope of the disclosed subject matter those modifications, substitutions, and variations as may come to those skilled in the art based on the teachings herein.

FIGS. 13*a*-13*d* illustrate the measured radiation patterns of an exemplary non-limiting embodiment of a 36-port MIMO cube (e.g., 400) at 2.8 GHz in the x-z plane (1300*a*) at Port x1, in the y-z plane (1300*b*) at Port x1, in the x-z plane (1300*c*) at Port z5, and in the y-z plane (1300*d*) at Port z5, according to one aspect of the disclosed subject matter. Measurement of the particular embodiment of the cube antenna designs of the disclosed subject matter show that the gains and efficiencies of Port x1 and Port z6 are 4.3 dBi, 57% and 4.2 dBi, 50%, respectively. Advantageously, according to various non-limiting embodiments, the disclosed subject matter provides antennas, even across different antenna types, having similar gains and efficiencies to provide good balanced diversity or MIMO operations.

DETAILED DESCRIPTION

Estimated and Measured Capacities

As one important application for the various embodiments of the disclosed subject matter is in MIMO systems, it is important to attempt to estimate the capacity that is possible from the 36-port antennas. One difficulty with this approach is that MIMO test-beds are often designed to handle a small number of ports, while typically, more than a 12×12 MIMO system is unusual. Accordingly, particular embodiments of the disclosed subject matter have been evaluated using a 4×4 MIMO test-bed. The capacity of embodiments of the disclosed subject matter can be measured by collecting as many 4×4 combinations as possible while determining the worst and best cases. Although a compromise to providing a full test of the particular embodiments of the disclosed subject matter, the evaluation can provide valuable insight into the potential MIMO capabilities of the various non-limiting embodiments. Additionally, the full MIMO capabilities of the various non-limiting MIMO cube antenna designs have been simulated by measuring the mutual couplings of all 36 ports of the cube and inserting this matrix into a simulation of the MIMO capacity to provide further insight into the advantages of the disclosed subject matter.

Figure 14:
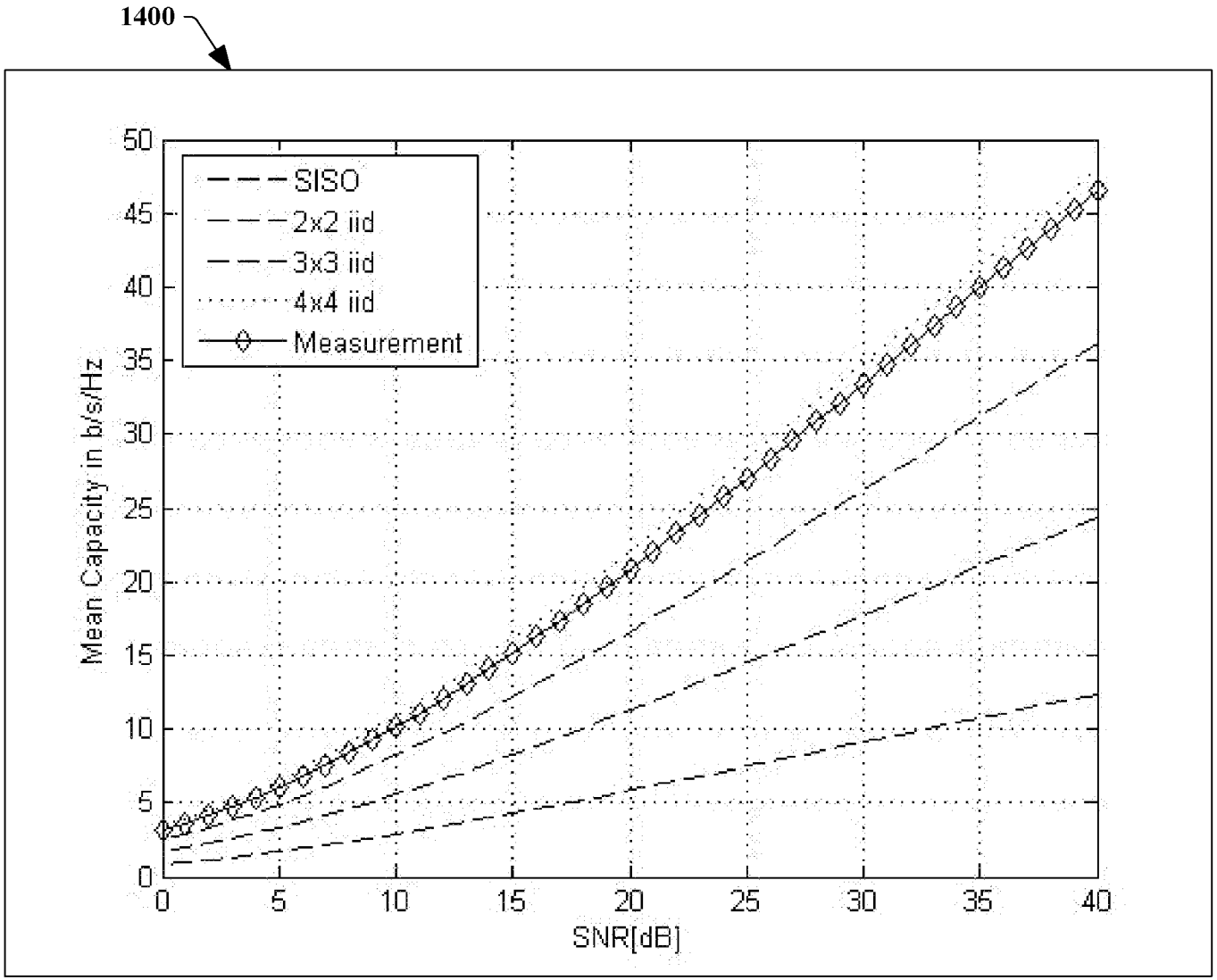
FIG. 14 illustrates measured channel capacity of an exemplary non-limiting embodiment of a 36-port cube using a 4×4 MIMO test bed according to one aspect of the disclosed subject matter.

Channel measurements were taken assuming a rich scattering environment throughout the measurement by using a real-world environment (e.g., laboratory full of scatter sources with transmitter continuously moving forward and backward). Measurements are repeated approximately one hundred times so as many of the possible four combinations of 4-ports from 36-ports are measured on the 4×4 MIMO test-bed as possible. All ports not currently measured are terminated by matched loads, while the receiving antenna consisted of 4 widely separated dipole antennas with low mutual coupling. The worst measured 4×4 channel capacity of the 36-port cube (e.g., 400) is shown in FIG. 14, where the ideal 4×4 MIMO capacity is also depicted. Accordingly, the measured 4×4 MIMO capacity is shown to be very close to the ideal capacity indicating that the mutual coupling found in the disclosed MIMO cube is low enough to limit negative effects on the overall performance of the particular non-limiting embodiment (e.g., 400 36-port MIMO cube antenna) tested. Similar results hold for the particular non-limiting embodiment (e.g., 200) of the disclosed 24-port MIMO cube antenna design.

Figure 15:
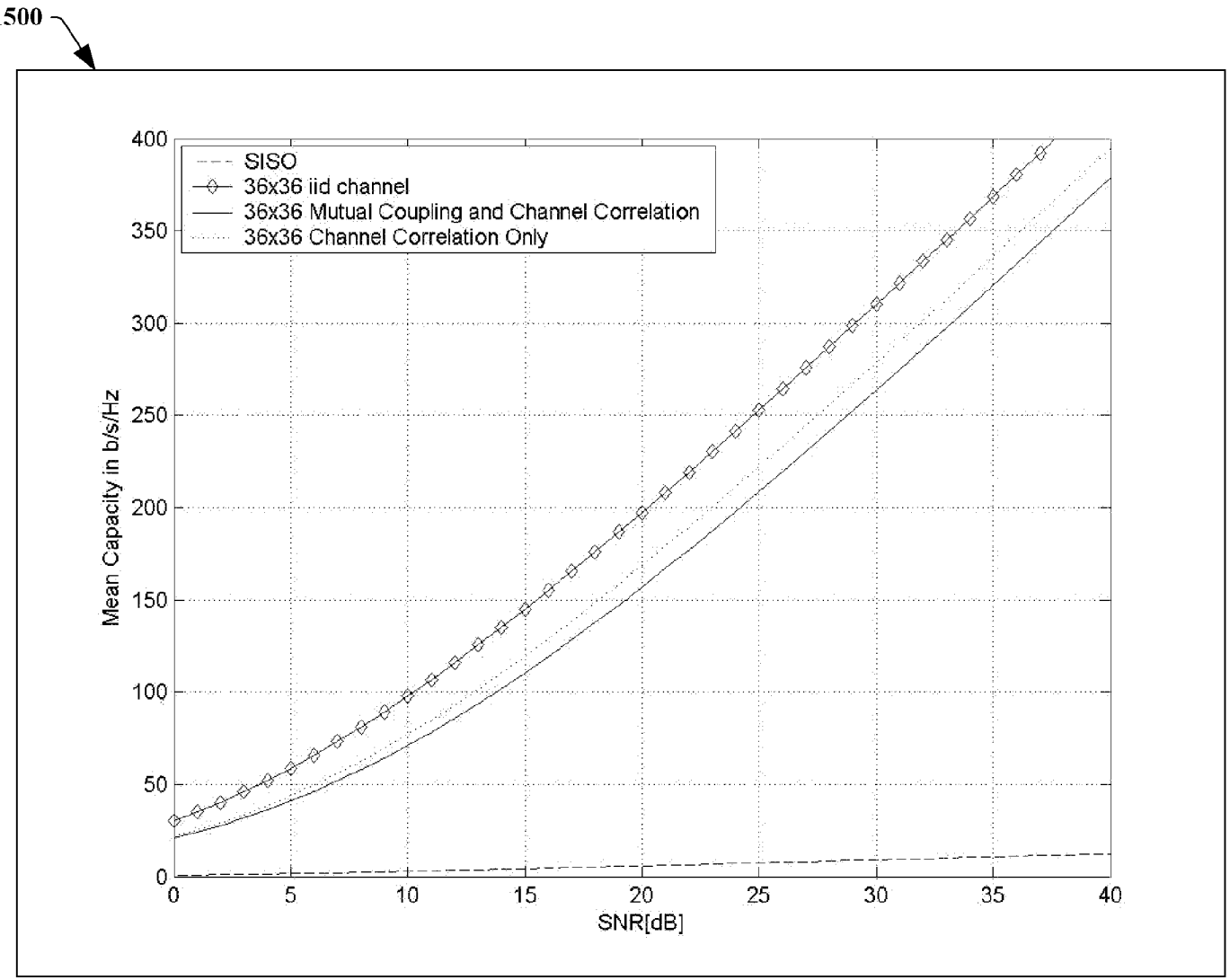
FIG. 15 illustrates the estimated channel capacity of an exemplary non-limiting embodiment of a 36-port cube according to one aspect of the disclosed subject matter.

FIG. 15 illustrates the estimated channel capacity of an exemplary non-limiting embodiment of a 36-port MIMO cube antenna (e.g., 400) according to one aspect of the disclosed subject matter. The estimated channel capacity for the 36-port cube (e.g., 400) is given where a channel correlation of ⅓ is assumed. The capacity is shown as 157 b/s/Hz at an SNR of 20 dB per receiver branch, in which case 36×36 mutual coupling and channel correlation are both considered. For comparison, a capacity of 197 b/s/Hz is shown for independent identically distributed (i.i.d.) Rayleigh fading channels. As can be understood, the effect of channel correlation on the reduction in potential MIMO capacity is more than that caused by the antenna mutual coupling. In fact, if only mutual coupling were included then a similar result to that in FIG. 14 would occur where the reduction is shown to be relatively minor. Similar results hold for the particular non-limiting embodiment (e.g., 200) of the disclosed 24-port antenna with a capacity of 107 b/s/Hz at an SNR of 20 dB per receiver branch compared to a capacity of 132 b/s/Hz for independent identically distributed Rayleigh fading channels.

Exemplary Computer Networks and Environments

One of ordinary skill in the art can appreciate that embodiments of the disclosed subject matter can be implemented in connection with any computer or other client or server device, which can be deployed as part of a wireless communications system, a computer network, or in a distributed computing environment, connected to any kind of data store. In this regard, the disclosed subject matter pertains to any computer system or environment having any number of memory or storage units, and any number of applications and processes occurring across any number of storage units or volumes, which may be used in connection with wireless communication systems using the antenna designs in accordance with the disclosed subject matter. The disclosed subject matter may apply to an environment with server computers and client computers deployed in a network environment or a distributed computing environment, having remote or local storage. The disclosed subject matter may also be applied to standalone computing devices, having programming language functionality, interpretation and execution capabilities for generating, receiving and transmitting information in connection with remote or local services and processes.

Distributed computing provides sharing of computer resources and services by exchange between computing devices and systems. These resources and services include the exchange of information, cache storage and disk storage for objects, such as files. Distributed computing takes advantage of network connectivity, allowing clients to leverage their collective power to benefit the entire enterprise. In this regard, a variety of devices may have applications, objects or resources that may implicate the wireless communication systems using the antenna designs of the disclosed subject matter.

Figure 17:
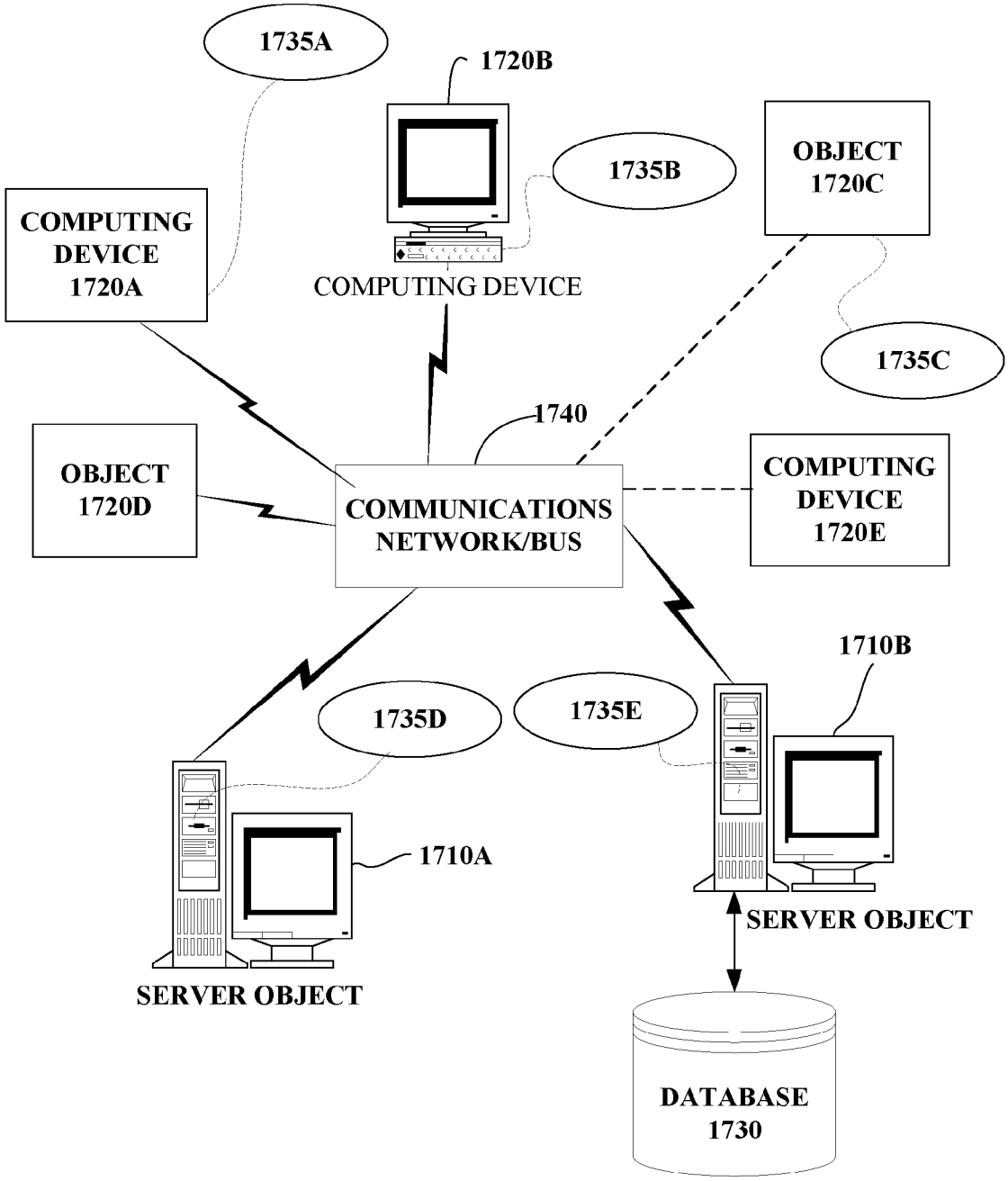
FIG. 17 is a block diagram representing an exemplary non-limiting networked environment in which embodiments of the disclosed subject matter can be implemented.

FIG. 17 provides a schematic diagram of an exemplary networked or distributed computing environment. The distributed computing environment comprises computing objects 1710*a*, 1710*b*, etc. and computing objects or devices 1720*a*, 1720*b*, 1720*c*, 1720*d*, 1720*e*, etc. These objects may comprise programs, methods, data stores, programmable logic, etc. The objects may comprise portions of the same or different devices such as PDAs, audio/video devices, MP3 players, personal computers, etc. Each object can communicate with another object by way of the communications network 1740. This network may itself comprise other computing objects and computing devices that provide services to the system of FIG. 17, and may itself represent multiple interconnected networks. In accordance with an aspect of the disclosed subject matter, each object 1710*a*, 1710*b*, etc. or 1720*a*, 1720*b*, 1720*c*, 1720*d*, 1720*e*, etc. may contain an application that might make use of an API, or other object, software, firmware and/or hardware, suitable for use with the design framework in accordance with the disclosed subject matter.

It can also be appreciated that an object, such as 1720*c*, may be hosted on another computing device 1710*a*, 1710*b*, etc. or 1720*a*, 1720*b*, 1720*c*, 1720*d*, 1720*e*, etc. Thus, although the physical environment depicted may show the connected devices as computers, such illustration is merely exemplary and the physical environment may alternatively be depicted or described comprising various digital devices such as PDAs, televisions, MP3 players, etc., any of which may employ a variety of wired and wireless services, software objects such as interfaces, COM objects, and the like.

There are a variety of systems, components, and network configurations that support distributed computing environments. For example, computing systems may be connected together by wired or wireless systems, by local networks or widely distributed networks. Currently, many of the networks are coupled to the Internet, which provides an infrastructure for widely distributed computing and encompasses many different networks. Any of the infrastructures may be used for communicating information used in the wireless communication systems using the antenna designs according to the disclosed subject matter.

The Internet commonly refers to the collection of networks and gateways that utilize the Transmission Control Protocol/Internet Protocol (TCP/IP) suite of protocols, which are well-known in the art of computer networking. The Internet can be described as a system of geographically distributed remote computer networks interconnected by computers executing networking protocols that allow users to interact and share information over network(s). Because of such wide-spread information sharing, remote networks such as the Internet have thus far generally evolved into an open system with which developers can design software applications for performing specialized operations or services, essentially without restriction.

Thus, the network infrastructure enables a host of network topologies such as client/server, peer-to-peer, or hybrid architectures. The "client" is a member of a class or group that uses the services of another class or group to which it is not related. Thus, in computing, a client is a process, e.g. roughly a set of instructions or tasks, that requests a service provided by another program. The client process utilizes the requested service without having to "know" any working details about the other program or the service itself. In a client/server architecture, particularly a networked system, a client is usually a computer that accesses shared network resources provided by another computer, e.g., a server. In the illustration of FIG. 17, as an example, computers 1720*a*, 1720*b*, 1720*c*, 1720*d*, 1720*e*, etc. can be thought of as clients and computers 1710*a*, 1710*b*, etc. can be thought of as servers where servers 1710*a*, 1710*b*, etc. maintain the data that is then replicated to client computers 1720*a*, 1720*b*, 1720*c*, 1720*d*, 1720*e*, etc., although any computer can be considered a client, a server, or both, depending on the circumstances. Any of these computing devices may be processing data or requesting services or tasks that may use or implicate the wireless communication systems using the antenna designs in accordance with the disclosed subject matter.

A server is typically a remote computer system accessible over a remote or local network, such as the Internet or wireless network infrastructures. The client process may be active in a first computer system, and the server process may be active in a second computer system, communicating with one another over a communications medium, thus providing distributed functionality and allowing multiple clients to take advantage of the information-gathering capabilities of the server. Any software objects utilized pursuant to wireless communication using the antenna designs of the disclosed subject matter may be distributed across multiple computing devices or objects.

Client(s) and server(s) communicate with one another utilizing the functionality provided by protocol layer(s). For example, HyperText Transfer Protocol (HTTP) is a common protocol that is used in conjunction with the World Wide Web (WWW), or "the Web." Typically, a computer network address such as an Internet Protocol (IP) address or other reference such as a Universal Resource Locator (URL) can be used to identify the server or client computers to each other.

The network address can be referred to as a URL address. Communication can be provided over a communications medium, e.g. client(s) and server(s) may be coupled to one another via TCP/IP connection(s) for high-capacity communication.

Thus, FIG. 17 illustrates an exemplary networked or distributed environment, with server(s) in communication with client computer (s) via a network/bus, in which the disclosed subject matter may be employed. In more detail, a number of servers 1710*a*, 1710*b*, etc. are interconnected via a communications network/bus 1740, which may be a LAN, WAN, intranet, GSM network, the Internet, etc., with a number of client or remote computing devices 1720*a*, 1720*b*, 1720*c*, 1720*d*, 1720*e*, etc., such as a portable computer, handheld computer, thin client, networked appliance, or other device, such as a VCR, TV, oven, light, heater and the like in accordance with the disclosed subject matter. It is thus contemplated that the disclosed subject matter may apply to any computing device in connection with which it is desirable to communicate data over a network.

In a network environment in which the communications network/bus 1740 is the Internet, for example, the servers 1710*a*, 1710*b*, etc. can be Web servers with which the clients 1720*a*, 1720*b*, 1720*c*, 1720*d*, 1720*e*, etc. communicate via any of a number of known protocols such as HTTP. Servers 1710*a*, 1710*b*, etc. may also serve as clients 1720*a*, 1720*b*, 1720*c*, 1720*d*, 1720*e*, etc., as may be characteristic of a distributed computing environment.

As mentioned, communications to or from the systems incorporating the antenna designs of the disclosed subject matter may ultimately pass through various media, either wired or wireless, or a combination, where appropriate. Client devices 1720*a*, 1720*b*, 1720*c*, 1720*d*, 1720*e*, etc. may or may not communicate via communications network/bus 14, and may have independent communications associated therewith. For example, in the case of a TV or VCR, there may or may not be a networked aspect to the control thereof. Each client computer 1720*a*, 1720*b*, 1720*c*, 1720*d*, 1720*e*, etc. and server computer 1710*a*, 1710*b*, etc. may be equipped with various application program modules or objects 1735*a*, 1735*b*, 1735*c*, etc. and with connections or access to various types of storage elements or objects, across which files or data streams may be stored or to which portion(s) of files or data streams may be downloaded, transmitted or migrated. Any one or more of computers 1710*a*, 1710*b*, 1720*a*, 1720*b*, 1720*c*, 1720*d*, 1720*e*, etc. may be responsible for the maintenance and updating of a database 1730 or other storage element, such as a database or memory 1730 for storing data processed or saved based on communications made according to the disclosed subject matter. Thus, embodiments of the disclosed subject matter can be utilized in a computer network environment having client computers 1720*a*, 1720*b*, 1720*c*, 1720*d*, 1720*e*, etc. that can access and interact with a computer network/bus 1740 and server computers 1710*a*, 1710*b*, etc. that may interact with client computers 1720*a*, 1720*b*, 1720*c*, 1720*d*, 1720*e*, etc. and other like devices, and databases 1730.

Exemplary Computing Device

Figure 18:
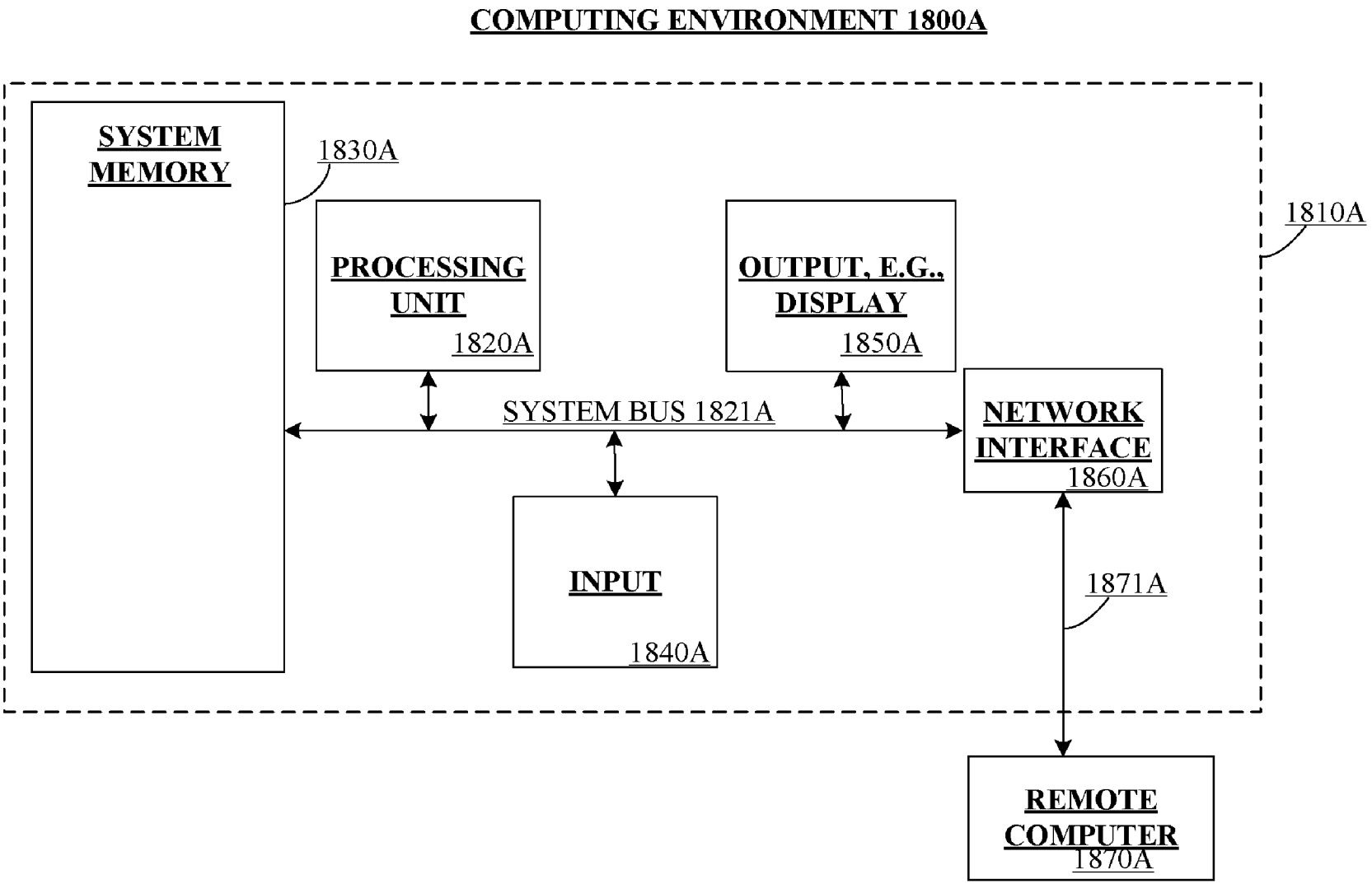
FIG. 18 is a block diagram representing an exemplary non-limiting computing system or operating environment in which embodiments of the disclosed subject matter can be implemented.

As mentioned, the disclosed subject matter applies to any device wherein it may be desirable to communicate data, e.g. to or from a mobile device. It should be understood, therefore, that handheld, portable and other computing devices and computing objects of all kinds are contemplated for use in connection with the disclosed subject matter, e.g., anywhere that a device may communicate data or otherwise receive, process or store data. Accordingly, the below general purpose remote computer described below in FIG. 18 is but one example, and the disclosed subject matter may be implemented with any client having network/bus interoperability and interaction. Thus, the disclosed subject matter may be implemented in an environment of networked hosted services in which very little or minimal client resources are implicated, e.g., a networked environment in which the client device serves merely as an interface to the network/bus, such as an object placed in an appliance.

Although not required, some aspects of the disclosed subject matter can partly be implemented via an operating system, for use by a developer of services for a device or object, and/or included within application software that operates in connection with the component(s) of the disclosed subject matter. Software may be described in the general context of computer-executable instructions, such as program modules, being executed by one or more computers, such as client workstations, servers or other devices. Those skilled in the art will appreciate that embodiments of the disclosed subject matter may be practiced with other computer system configurations and protocols.

FIG. 18 thus illustrates an example of a suitable computing system environment 1800*a* in which some aspects of the disclosed subject matter may be implemented, although as made clear above, the computing system environment 1800*a* is only one example of a suitable computing environment for a media device and is not intended to suggest any limitation as to the scope of use or functionality of the disclosed subject matter. Neither should the computing environment 1800*a* be interpreted as having any dependency or requirement relating to any one or combination of components illustrated in the exemplary operating environment 1800*a*.

With reference to FIG. 18, an exemplary remote device for implementing embodiments of the disclosed subject matter includes a general purpose computing device in the form of a computer 1810*a*. Components of computer 1810*a* may include, but are not limited to, a processing unit 1820*a*, a system memory 1830*a*, and a system bus 1821*a* that couples various system components including the system memory to the processing unit 1820*a*. The system bus 1821*a* may be any of several types of bus structures including a memory bus or memory controller, a peripheral bus, and a local bus using any of a variety of bus architectures.

Computer 1810*a* typically includes a variety of computer readable media. Computer readable media can be any available media that can be accessed by computer 1810*a*. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CDROM, digital versatile disks (DVD) or other optical disk storage, magnetic cassettes, magnetic tape, magnetic disk storage or other magnetic storage devices, or any other medium which can be used to store the desired information and which can be accessed by computer 1810*a*. Communication media typically embodies computer readable instructions, data structures, program modules or other data in a modulated data signal such as a carrier wave or other transport mechanism and includes any information delivery media.

The system memory 1830*a* may include computer storage media in the form of volatile and/or nonvolatile memory such as read only memory (ROM) and/or random access memory (RAM). A basic input/output system (BIOS), containing the basic routines that help to transfer information between elements within computer 1810*a*, such as during start-up, may be stored in memory 1830*a*. Memory 1830*a* typically also contains data and/or program modules that are immediately accessible to and/or presently being operated on by processing unit 1820*a*. By way of example, and not limitation, memory 1830*a* may also include an operating system, application programs, other program modules, and program data.

The computer 1810*a* may also include other removable/non-removable, volatile/nonvolatile computer storage media. For example, computer 1810*a* could include a hard disk drive that reads from or writes to non-removable, nonvolatile magnetic media, a magnetic disk drive that reads from or writes to a removable, nonvolatile magnetic disk, and/or an optical disk drive that reads from or writes to a removable, nonvolatile optical disk, such as a CD-ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM and the like. A hard disk drive is typically connected to the system bus 1821*a* through a non-removable memory interface such as an interface, and a magnetic disk drive or optical disk drive is typically connected to the system bus 1821*a* by a removable memory interface, such as an interface.

A user may enter commands and information into the computer 1810*a* through input devices such as a keyboard and pointing device, commonly referred to as a mouse, trackball or touch pad. Other input devices may include a microphone, joystick, game pad, satellite dish, scanner, wireless device keypad, voice commands, or the like. These and other input devices are often connected to the processing unit 1820*a* through user input 1840*a* and associated interface(s) that are coupled to the system bus 1821*a*, but may be connected by other interface and bus structures, such as a parallel port, game port or a universal serial bus (USB). A graphics subsystem may also be connected to the system bus 1821*a*. A monitor or other type of display device is also connected to the system bus 1821*a* via an interface, such as output interface 1850*a*, which may in turn communicate with video memory. In addition to a monitor, computers may also include other peripheral output devices such as speakers and a printer, which may be connected through output interface 1850*a*.

The computer 1810*a* may operate in a networked or distributed environment using logical connections to one or more other remote computers, such as remote computer 1870*a*, which may in turn have media capabilities different from device 1810*a*. The remote computer 1870*a* may be a personal computer, a server, a router, a network PC, a peer device, personal digital assistant (PDA), cell phone, handheld computing device, or other common network node, or any other remote media consumption or transmission device, and may include any or all of the elements described above relative to the computer 1810*a*. The logical connections depicted in FIG. 18 include a network 1871*a*, such local area network (LAN) or a wide area network (WAN), but may also include other networks/buses, either wired or wireless. Such networking environments are commonplace in homes, offices, enterprise-wide computer networks, intranets and the Internet.

When used in a LAN networking environment, the computer 1810*a* is connected to the LAN 1871*a* through a network interface or adapter. When used in a WAN networking environment, the computer 1810*a* typically includes a communications component, such as a modem, or other means for establishing communications over the WAN, such as the Internet. A communications component, such as a modem, which may be internal or external, may be connected to the system bus 1821*a* via the user input interface of input 1840*a*, or other appropriate mechanism. In a networked environment, program modules depicted relative to the computer 1810*a*, or portions thereof, may be stored in a remote memory storage device. It will be appreciated that the network connections shown and described are exemplary and other means of establishing a communications link between the computers may be used.

While the disclosed subject matter has been described in connection with the preferred embodiments of the various Figures, it is to be understood that other similar embodiments may be used or modifications and additions may be made to the described embodiment for performing the same function of the disclosed subject matter without deviating therefrom. For example, one skilled in the art will recognize that the disclosed subject matter as described in the present application applies to wireless communication systems using the disclosed MIMO cube antenna designs and may be applied to any number of devices connected via a communications network and interacting across the network, either wired, wirelessly, or a combination thereof. In addition, it is understood that in various network configurations, access points may act as nodes and nodes may act as access points for some purposes. Therefore, the disclosed subject matter should not be limited to any single embodiment, but rather should be construed in breadth and scope in accordance with the appended claims.

Exemplary Communications Networks and Environments

The above-described wireless communication systems using the antenna disclosed MIMO cube antenna designs and processes may be applied to any network, however, the following description sets forth some exemplary telephony radio networks and non-limiting operating environments for communications made incident to the wireless communication systems using the antenna designs of the disclosed subject matter. The below-described operating environments should be considered non-exhaustive, however, and thus the below-described network architecture merely shows one network architecture into which embodiments of the disclosed subject matter may be incorporated. One can appreciate, however, that embodiments of the disclosed subject matter may be incorporated into any now existing or future alternative architectures for communication networks as well.

The global system for mobile communication ("GSM") is one of the most widely utilized wireless access systems in today's fast growing communication systems. GSM provides circuit-switched data services to subscribers, such as mobile telephone or computer users. General Packet Radio Service ("GPRS"), which is an extension to GSM technology, introduces packet switching to GSM networks. GPRS uses a packet-based wireless communication technology to transfer high and low speed data and signaling in an efficient manner. GPRS optimizes the use of network and radio resources, thus enabling the cost effective and efficient use of GSM network resources for packet mode applications.

As one of ordinary skill in the art can appreciate, the exemplary GSM/GPRS environment and services described herein can also be extended to 3G services, such as Universal Mobile Telephone System ("UMTS"), Frequency Division Duplexing ("FDD") and Time Division Duplexing ("TDD"), High Speed Packet Data Access ("HSPDA"), cdma2000 1x Evolution Data Optimized ("EVDO"), Code Division Multiple Access-2000 ("cdma2000 3x"), Time Division Synchronous Code Division Multiple Access ("TD-SCDMA"), Wideband Code Division Multiple Access ("WCDMA"), Enhanced Data GSM Environment ("EDGE"), International Mobile Telecommunications-2000 ("IMT-2000"), Digital Enhanced Cordless Telecommunications ("DECT"), etc., as well as to other network services that shall become available in time. In this regard, the antenna designs of the disclosed subject matter may be applied independently of the method of data transport, and does not depend on any particular network architecture, or underlying protocols.

Figure 19:
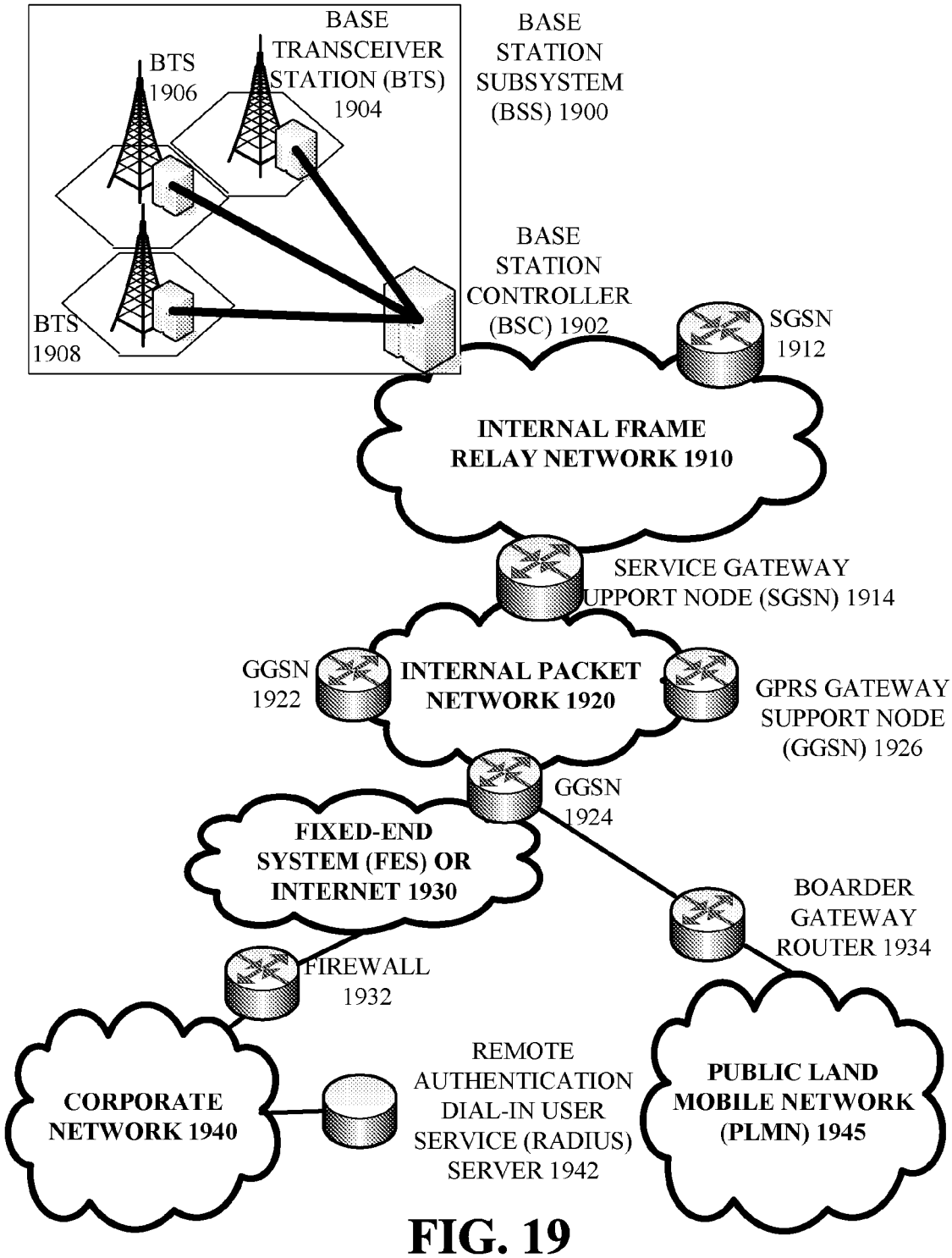
FIG. 19 illustrates an overview of a network environment suitable for service by embodiments of the disclosed subject matter.

FIG. 19 depicts an overall block diagram of an exemplary packet-based mobile cellular network environment, such as a GPRS network, in which embodiments of the disclosed subject matter may be practiced. In such an environment, there are a plurality of Base Station Subsystems ("BSS") 1900 (only one is shown), each of which comprises a Base Station Controller ("BSC") 1902 serving a plurality of Base Transceiver Stations ("BTS") such as BTSs 1904, 1906, and 1908. BTSs 1904, 1906, 1908, etc. are the access points where users of packet-based mobile devices become connected to the wireless network. In exemplary fashion, the packet traffic originating from user devices is transported over the air interface to a BTS 1908, and from the BTS 1908 to the BSC 1902. Base station subsystems, such as BSS 1900, are a part of internal frame relay network 1910 that may include Service GPRS Support Nodes ("SGSN") such as SGSN 1912 and 1914. Each SGSN is in turn connected to an internal packet network 1920 through which a SGSN 1912, 1914, etc. can route data packets to and from a plurality of gateway GPRS support nodes (GGSN) 1922, 1924, 1926, etc. As illustrated, SGSN 1914 and GGSNs 1922, 1924, and 1926 are part of internal packet network 1920. Gateway GPRS serving nodes 1922, 1924 and 1926 mainly provide an interface to external Internet Protocol ("IP") networks such as Public Land Mobile Network ("PLMN") 1945, corporate intranets 1940, or Fixed-End System ("FES") or the public Internet 1930. As illustrated, subscriber corporate network 1940 may be connected to GGSN 1924 via firewall 1932; and PLMN 1945 is connected to GGSN 1924 via boarder gateway router 1934. The Remote Authentication Dial-In User Service ("RADIUS") server 1942 may be used for caller authentication when a user of a mobile cellular device calls corporate network 1940.

Generally, there can be four different cell sizes in a GSM network—macro, micro, pico and umbrella cells. The coverage area of each cell is different in different environments. Macro cells can be regarded as cells where the base station antenna is installed in a mast or a building above average roof top level. Micro cells are cells whose antenna height is under average roof top level; they are typically used in urban areas. Pico cells are small cells having a diameter is a few dozen meters; they are mainly used indoors. On the other hand, umbrella cells are used to cover shadowed regions of smaller cells and fill in gaps in coverage between those cells.

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

Various implementations of the disclosed subject matter described herein may have aspects that are wholly in hardware, partly in hardware and partly in software, as well as in software. Furthermore, aspects may be fully integrated into a single component, be assembled from discrete devices, or implemented as a combination suitable to the particular application and is a matter of design choice. As used herein, the terms "node," "access point," "component," "system," and the like are likewise intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on computer and the computer can be a component. One or more components may reside within a process and/or thread of execution and a component may be localized on one computer and/or distributed between two or more computers.

Thus, the systems of the disclosed subject matter, or certain aspects or portions thereof, may take the form of program code (e.g., instructions) embodied in tangible media, such as floppy diskettes, CD-ROMs, hard drives, or any other machine-readable storage medium, wherein, when the program code is loaded into and executed by a machine, such as a computer, the machine becomes an apparatus for practicing the disclosed subject matter. In the case of program code execution on programmable computers, the computing device generally includes a processor, a storage medium readable by the processor (including volatile and non-volatile memory and/or storage elements), at least one input device, and at least one output device.

Furthermore, the some aspects of the disclosed subject matter may be implemented as a system, method, apparatus, or article of manufacture using standard programming and/or engineering techniques to produce software, firmware, hardware, or any combination thereof to control a computer or processor based device to implement aspects detailed herein. The terms "article of manufacture", "computer program product" or similar terms, where used herein, are intended to encompass a computer program accessible from any computer-readable device, carrier, or media. For example, computer readable media can include but are not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick). Additionally, it is known that a carrier wave can be employed to carry computer-readable electronic data such as those used in transmitting and receiving electronic mail or in accessing a network such as the Internet or a local area network (LAN).

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components, e.g., according to a hierarchical arrangement. Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but generally known by those of skill in the art.

While for purposes of simplicity of explanation, methodologies disclosed herein are shown and described as a series of blocks, it is to be understood and appreciated that the claimed subject matter is not limited by the order of the blocks, as some blocks may occur in different orders and/or concurrently with other blocks from what is depicted and described herein. Where non-sequential, or branched, flow is illustrated via flowchart, it can be appreciated that various other branches, flow paths, and orders of the blocks, may be implemented which achieve the same or a similar result. Moreover, not all illustrated blocks may be required to implement the methodologies described hereinafter.

Furthermore, as will be appreciated various portions of the disclosed systems may include or consist of artificial intelligence or knowledge or rule based components, sub-components, processes, means, methodologies, or mechanisms (e.g., support vector machines, neural networks, expert systems, Bayesian belief networks, fuzzy logic, data fusion engines, classifiers . . . ). Such components, inter alia, can automate certain mechanisms or processes performed thereby to make portions of the systems and methods more adaptive as well as efficient and intelligent.

While the disclosed subject matter has been described in connection with the particular embodiments of the various figures, it is to be understood that other similar embodiments may be used or modifications and additions may be made to the described embodiment for performing the same function of the disclosed subject matter without deviating therefrom. Still further, embodiments of the disclosed subject matter may be implemented in or across a plurality of processing chips or devices, and storage may similarly be effected across a plurality of devices. Therefore, the disclosed subject matter should not be limited to any single embodiment, but rather should be construed in breadth and scope in accordance with the appended claims.

What is claimed is:

1. A multiple-input-multiple-output (MIMO) antenna comprising:

a plurality of cross antenna elements each comprising a plurality of slot antenna elements, each of the plurality of slot antenna elements having an arrangement;

each arrangement of the plurality of slot antenna elements having a common shared space between the respective arranged plurality of slot antenna elements; and the plurality of cross antenna elements having a configuration that forms a substantially cubic structure.

2. The multiple-input-multiple-output (MIMO) antenna of claim 1, at least one of the arrangements of the plurality of slot antenna elements comprising a pair of substantially matched slot antenna elements arranged in a cross-polarized configuration.

3. The multiple-input-multiple-output (MIMO) antenna of claim 1, the configuration of the plurality of cross antenna elements forms a 24-port antenna cube, the antenna cube having edges substantially aligned with respective common shared spaces of the arrangements of the plurality of slot antenna elements.

4. The multiple-input-multiple-output (MIMO) antenna of claim 3, the slot antenna elements comprise quarter-wave slot antenna elements.

5. The multiple-input-multiple-output (MIMO) antenna of claim 4, the substantially cubic structure having substantially separate faces, the MIMO antenna further comprising six pairs of half-wave slot antenna elements, and each pair respectively placed on a separate face of the 24-port antenna cube to form a 36-port antenna cube.

6. The multiple-input-multiple-output (MIMO) antenna of claim 3, wherein the slot antenna elements comprise half-wave slot antenna elements.

7. The multiple-input-multiple-output (MIMO) antenna of claim 6, the substantially cubic structure having substantially separate faces, the MIMO antenna further comprising six pairs of adjacent quarter-wave slot antenna elements, each pair respectively placed on a separate face of the 24-port antenna cube to form a 36-port antenna cube.

8. The multiple-input-multiple-output (MIMO) antenna of claim 7, wherein each pair of adjacent quarter-wave slot antennas are arranged adjacent to a pair of L-stubs to suppress mutual coupling of the respective adjacent pair of quarter-wave slot antennas.

9. The multiple-input-multiple-output (MIMO) antenna of claim 1, wherein at least a portion of the substantially cubic structure is substantially formed from printed circuit board material upon which one or more of the plurality of slot antenna elements are formed.

10. A system for wireless communication comprising:

a wireless communication component operable to communicate wireless communications signals;

a multiple-input-multiple-output antenna component operatively coupled to the wireless communication component; and wherein the multiple-input-multiple-output antenna component further comprises a substantially cubic 24-port antenna structure, the antenna structure has edges comprising cross polarized antenna elements wherein each cross polarized antenna elements comprises slot antenna elements.

11. The system of claim 10, wherein the slot antenna elements comprise quarter-wave slot antenna elements.

12. The system of claim 11, the substantially cubic 24-port antenna structure has separate faces, the multiple-input-multiple-output antenna component further comprising six pairs of half-wave slot antenna elements, each pair respectively placed on a separate face of the 24-port antenna structure to form a 36-port antenna structure.

13. The system of claim 10, the slot antenna elements of the multiple-input-multiple-output antenna component comprise half-wave slot antenna elements, the 24-port antenna structure has separate faces, and wherein the multiple-input-multiple-output antenna component further comprises six pairs of adjacent quarter-wave slot antenna elements, each pair respectively placed on a separate face of the 24-port antenna structure to form a 36-port antenna structure.

14. A method of constructing a multiple-input-multiple-output (MIMO) cube antenna comprising:

forming a plurality of slot antenna elements;

interlacing a plurality of pairs of slot antenna elements to form a plurality of cross antenna elements; and configuring a plurality of cross antenna elements to form a substantially cubic structured surface having separate faces, wherein the plurality of cross antenna elements substantially form the edges of the substantially cubic structured surface.

15. The method of claim 14, further comprising locating a slot antenna element pair on at least one of the separate faces of the substantially cubic structured surface.

16. The method of claim 14, the interlacing includes interlacing the plurality of slot antenna element pairs to form the cross antenna elements in a cross-polarized configuration.

17. The method of claim 16, the forming includes forming the plurality of slot antenna elements as quarter-wave slot antenna elements and wherein the configuring includes configuring the plurality of cross antenna elements to form a 24-port antenna cube.

18. The method of claim 15 the forming includes forming the plurality of slot antenna elements as half-wave slot antenna elements, the configuring includes configuring the plurality of cross antenna elements to form 24 ports of an antenna cube, and the locating a slot antenna element pair on at least one of the separate faces includes locating six slot antenna element pairs on the separate faces of the substantially cubic structure to form 12 additional ports of the antenna cube.

19. The method of claim 18, wherein the locating six slot antenna element pairs includes locating six quarter-wave slot antenna element pairs and locating said quarter-wave slot antenna element pairs adjacent to a pair of L-stubs to suppress mutual coupling.

20. The method of claim 14, wherein forming step includes forming the plurality of slot antenna elements substantially from a printed circuit board material.

* * * * *

UNITED STATES PATENT AND TRADEMARK OFFICE

CERTIFICATE OF CORRECTION

PATENT NO. : 7,920,099 B2
APPLICATION NO. : 12/129025
DATED : April 5, 2011
INVENTOR(S) : Chiu et al.

It is certified that error appears in the above-identified patent and that said Letters Patent is hereby corrected as shown below:

Column 20, line 36, in Claim 10, delete “cross polarized” and insert -- cross-polarized --.

Column 20, line 37, in Claim 10, delete “cross polarized” and insert -- cross-polarized --.

Column 21, line 12, in Claim 18, delete “24 ports” and insert -- 24-ports --.

Signed and Sealed this
Twentieth Day of September, 2011

David J. Kappos

David J. Kappos
*Director of the United States Patent and Trademark Office*